US010415169B2

(12) United States Patent
Hall et al.

(10) Patent No.: US 10,415,169 B2
(45) **Date of Patent: *Sep. 17, 2019**

(54) SYSTEM AND METHOD FOR FORMING PATTERNED ARTIFICIAL/SYNTHETIC SPORTS TURF FABRICS

(71) Applicant: CARD-MONROE CORP., Chattanooga, TN (US)

(72) Inventors: Wilton Hall, Ringgold, GA (US); Todd Woodall, Soddy Daisy, TN (US); Ricky E. Mathews, Sale Creek, TN (US)

(73) Assignee: Card-Monroe Corp., Chattanooga, TN (US)

( * ) Notice: Subject to any disclaimer, the term of this patent is extended or adjusted under 35 U.S.C. 154(b) by 168 days.

This patent is subject to a terminal disclaimer.

(21) Appl. No.: 15/618,613

(22) Filed: Jun. 9, 2017

(65) Prior Publication Data

US 2017/0321362 A1 Nov. 9, 2017

Related U.S. Application Data

(63) Continuation of application No. 14/275,306, filed on May 12, 2014, now Pat. No. 9,677,210.

(Continued)

(51) Int. Cl.

*D05C 15/08* (2006.01)
*D05C 15/12* (2006.01)

(Continued)

(52) U.S. Cl.

CPC ..... *D05C 15/12* (2013.01); *D05C 15/00* (2013.01); *D05C 15/08* (2013.01); *D05C 15/32* (2013.01);

(Continued)

(58) Field of Classification Search

CPC ..... D05C 15/00; D05C 15/08; D05C 15/26; D05C 15/20; B68G 7/08

See application file for complete search history.

(56) References Cited

U.S. PATENT DOCUMENTS 2,879,728 A 3/1959 McCutchen
2,889,791 A 6/1959 Fedevich (Continued)

FOREIGN PATENT DOCUMENTS

GB 1 541 074 2/1979
GB 2002040 7/1979

(Continued)

OTHER PUBLICATIONS

International Preliminary Report on Patentability dated Nov. 26, 2015 for PCT/US2014/037671.

(Continued)

*Primary Examiner* — Tajash D Patel

(74) *Attorney, Agent, or Firm* — Womble Bond Dickinson (US) LLP

(57) ABSTRACT

A system and method for forming synthetic/artificial grass or turf products in which a series of tufts of artificial/synthetic grass filaments or yarns are formed in a backing material with various graphic pattern effects being formed therewith. The system generally will include at least one needle bar having at least one row of needles mounted along a tufting zone and reciprocated through the backing to a desired penetration depth, and will present a desired set or group of yarns to a series of pattern pixels or stitch areas. A series of level cut loop loopers or hooks will be aligned with and will engage the needles in order to form tufts of yarns in the backing material. Clips of the level cut loop loopers will be selectively controlled to control the retention of selected ones of the yarns presented at each pattern pixel. The remaining, non-selected yarns generally are not retained at (Continued)

the pattern pixels, and can be formed as lower pile tufts or removed from the backing material.

19 Claims, 13 Drawing Sheets

Related U.S. Application Data

(60) Provisional application No. 61/894,635, filed on Oct. 23, 2013, provisional application No. 61/822,465, filed on May 13, 2013.

(51) Int. Cl.

| | |
|---|---|
| ***D05C 15/32*** | (2006.01) |
| ***D05C 15/36*** | (2006.01) |
| ***D05C 15/00*** | (2006.01) |
| ***D05C 15/34*** | (2006.01) |
| ***E01C 13/08*** | (2006.01) |

(52) U.S. Cl.
CPC ..... *D05C 15/34* (2013.01); *D05C 15/36* (2013.01); *E01C 13/08* (2013.01); *D10B 2505/202* (2013.01)

(56) References Cited

U.S. PATENT DOCUMENTS

| | | | |
|---|---|---|---|
| 2,982,240 | A | 5/1961 | Kelly |
| 2,990,792 | A | 7/1961 | Nowicki et al. |
| 3,084,645 | A | 4/1963 | Card |
| 3,103,903 | A | 9/1963 | Broadrick et al. |
| 3,286,670 | A | 11/1966 | Boyles |
| 3,375,797 | A | 4/1968 | Gaines |
| 3,489,326 | A | 1/1970 | Singleton |
| 3,577,943 | A | 5/1971 | Watkins |
| 3,662,697 | A | 5/1972 | Passons et al. |
| 3,709,173 | A | 1/1973 | Greene |
| 3,757,709 | A | 9/1973 | Cobble |
| 3,780,678 | A | 12/1973 | Short |
| 3,835,797 | A | 9/1974 | Franks et al. |
| 3,847,098 | A | 11/1974 | Hammel, Jr. |
| 3,919,953 | A | 11/1975 | Card et al. |
| 4,048,930 | A | 9/1977 | Card |
| 4,103,629 | A | 8/1978 | Card |
| 4,119,049 | A | 10/1978 | Puckett |
| 4,134,348 | A | 1/1979 | Scott |
| 4,138,956 | A | 2/1979 | Parsons |
| 4,155,319 | A | 5/1979 | Short |
| 4,185,569 | A | 1/1980 | Inman |
| 4,195,580 | A | 4/1980 | Hurst |
| 4,195,584 | A | 4/1980 | Falk et al. |
| 4,217,837 | A | 8/1980 | Beasley et al. |
| 4,226,196 | A | 10/1980 | Booth |
| 4,241,676 | A | 12/1980 | Parsons et al. |
| 4,245,574 | A | 1/1981 | Wilson |
| 4,303,024 | A | 12/1981 | Bardsley |
| 4,313,388 | A | 2/1982 | Biggs et al. |
| 4,353,317 | A | 10/1982 | Crumbliss |
| 4,366,761 | A | 1/1983 | Card |
| 4,397,249 | A | 8/1983 | Slattery |
| 4,398,479 | A | 8/1983 | Czelusniak, Jr. |
| 4,419,944 | A | 12/1983 | Passons et al. |
| 4,440,102 | A | 4/1984 | Card et al. |
| 4,448,137 | A | 5/1984 | Curtis et al. |
| 4,466,366 | A | 8/1984 | Hirotsu |
| 4,491,078 | A | 1/1985 | Ingram |
| 4,522,132 | A | 6/1985 | Slattery |
| 4,557,208 | A | 12/1985 | Ingram et al. |
| 4,557,209 | A | 12/1985 | Watkins |
| 4,574,716 | A | 3/1986 | Czelusniak, Jr. |
| 4,608,934 | A | 9/1986 | Card et al. |
| 4,619,212 | A | 10/1986 | Card et al. |
| 4,630,558 | A | 12/1986 | Card et al. |
| 4,637,329 | A | 1/1987 | Czelusniak, Jr. |
| 4,667,611 | A | 5/1987 | Yamamoto et al. |
| 4,669,171 | A | 6/1987 | Card et al. |
| 4,739,717 | A | 4/1988 | Bardsley |
| 4,754,718 | A | 7/1988 | Watkins |
| 4,800,828 | A | 1/1989 | Watkins |
| 4,815,403 | A | 3/1989 | Card et al. |
| 4,836,118 | A | 6/1989 | Card et al. |
| 4,841,886 | A | 6/1989 | Watkins |
| 4,856,441 | A | 8/1989 | Kurata |
| 4,860,674 | A | 8/1989 | Slattery |
| 4,864,946 | A | 9/1989 | Watkins |
| 4,903,624 | A | 2/1990 | Card et al. |
| 4,903,625 | A | 2/1990 | Card et al. |
| 4,993,336 | A | 2/1991 | Mizunuma |
| 5,058,518 | A | 10/1991 | Card et al. |
| 5,094,178 | A | 3/1992 | Watkins |
| 5,182,997 | A | 2/1993 | Bardsley |
| 5,224,434 | A | 7/1993 | Card et al. |
| 5,295,450 | A | 3/1994 | Neely |
| 5,400,727 | A | 3/1995 | Neely |
| 5,499,588 | A | 3/1996 | Card et al. |
| 5,509,364 | A | 4/1996 | Bardsley |
| 5,513,586 | A | 5/1996 | Neely |
| 5,566,630 | A | 10/1996 | Burgess et al. |
| 5,575,228 | A | 11/1996 | Padgett et al. |
| 5,622,126 | A | 4/1997 | Card et al. |
| 5,706,744 | A | 1/1998 | Card et al. |
| 5,743,201 | A | 4/1998 | Card et al. |
| 5,896,821 | A | 4/1999 | Neely et al. |
| 5,899,152 | A | 5/1999 | Bardsley |
| 5,979,344 | A | 11/1999 | Christman, Jr. |
| 5,983,815 | A | 11/1999 | Card |
| 6,009,818 | A | 1/2000 | Card et al. |
| 6,155,187 | A | 12/2000 | Bennett et al. |
| RE37,108 | E | 3/2001 | Neely |
| 6,213,036 | B1 | 4/2001 | Slattery |
| 6,244,203 | B1 | 6/2001 | Morgante et al. |
| 6,263,811 | B1 | 7/2001 | Crossley |
| 6,279,497 | B1 | 8/2001 | Lovelady |
| 6,283,811 | B1 | 9/2001 | Peterson |
| 6,439,141 | B2 | 8/2002 | Morgante et al. |
| 6,446,566 | B1 | 9/2002 | Bennett et al. |
| 6,502,521 | B2 | 1/2003 | Morgante et al. |
| 6,508,185 | B1 | 1/2003 | Morgante et al. |
| 6,516,734 | B1 | 2/2003 | Morgante et al. |
| 6,550,407 | B1 | 4/2003 | Frost et al. |
| 6,672,230 | B2 | 1/2004 | Green et al. |
| 6,758,154 | B2 | 7/2004 | Johnston |
| 6,807,917 | B1 | 10/2004 | Christman et al. |
| 6,834,601 | B2 | 12/2004 | Card et al. |
| 6,834,602 | B1 | 12/2004 | Hall |
| 7,007,617 | B2 | 3/2006 | Johnston |
| 7,107,918 | B2 | 9/2006 | Caylor et al. |
| 7,216,598 | B1 | 5/2007 | Chrtstman, Jr. |
| 7,237,497 | B2 | 7/2007 | Johnston |
| 7,296,524 | B2 | 11/2007 | Beverly |
| 7,438,007 | B1 | 10/2008 | Hall |
| 7,490,566 | B2 | 2/2009 | Hall |
| 7,634,326 | B2 | 12/2009 | Christman, Jr. et al. |
| 7,739,970 | B2 | 6/2010 | Hall |
| 8,082,861 | B2 | 12/2011 | Lovelady et al. |
| 8,240,263 | B1 | 8/2012 | Frost |
| 8,347,800 | B1 | 1/2013 | Machell-Archer et al. |
| 8,443,743 | B2 | 5/2013 | Christman, Jr. |
| 8,646,396 | B2 | 2/2014 | Shanley |
| 8,776,703 | B2 | 7/2014 | Hall |
| 9,677,210 | B2 | 6/2017 | Hall et al. |
| 2004/0187268 | A1 | 9/2004 | Johnston |
| 2006/0150882 | A1 | 7/2006 | Johnston |
| 2007/0272137 | A1 | 11/2007 | Christman et al. |
| 2008/0210146 | A1 | 9/2008 | Hall |
| 2009/0050037 | A1 | 2/2009 | Hall et al. |
| 2012/0174846 | A1 | 7/2012 | Hall |
| 2014/0000497 | A1 | 1/2014 | Modra |
| 2014/0331906 | A1* | 11/2014 | Hall ..... D05C 15/12 112/475.23 |

(56) References Cited

U.S. PATENT DOCUMENTS

2015/0354118 A1* 12/2015 Mathews ..... D05B 69/12
112/80.73

FOREIGN PATENT DOCUMENTS

| | | |
|---|---|---|
| GB | 2050477 | 1/1981 |
| GB | 2165560 | 4/1986 |
| GB | 2246371 | 1/1992 |
| GB | 2266537 | 11/1996 |
| WO | WO 01/20069 | 3/2001 |
| WO | WO 03056091 | 7/2003 |
| WO | WO2004/057111 | 8/2004 |
| WO | WO 2005054561 | 6/2005 |
| WO | WO2006/075241 | 7/2006 |
| WO | WO 2010003050 | 1/2010 |

OTHER PUBLICATIONS

International Search Report and Written Opinion for related PCT application No. PCT/US2014/037671, dated Sep. 26, 2014.
Extended European Search Report, for related application No. EP 14798458.7, dated Dec. 15, 2016.

* cited by examiner

SYSTEM AND METHOD FOR FORMING PATTERNED ARTIFICIAL/SYNTHETIC SPORTS TURF FABRICS

CROSS REFERENCE TO RELATED APPLICATIONS

The present Patent Application is a continuation patent application of previously-filed co-pending U.S. patent application Ser. No. 14/275,306, filed May 12, 2014, which is a formalization of previously filed U.S. Provisional Patent Application Ser. No. 61/822,465, filed May 13, 2013 and U.S. Provisional Patent Application Ser. No. 61/894,635, filed Oct. 23, 2013 by the inventors named in the present Application. This Patent Application claims the benefit of the filing date of these cited Patent Applications according to the statutes and rules governing patent applications, particularly 35 U.S.C. § 119(a)(i) and 37 C.F.R. § 1.78(a)(4) and (a)(5). The specification and drawings of each of the Patent Applications referenced above are specifically incorporated herein by reference as if set forth in their entireties.

FIELD OF THE INVENTION

The present invention generally relates to tufted fabrics or products and in particular to a method and system for forming tufted fabrics having patterned designs formed therein, including formation of patterned artificial/synthetic sports grass or turf fabrics or products.

BACKGROUND OF THE INVENTION

Carpets and other tufted fabric products having logos, script designs and other complex patterned graphics have become increasingly popular as tufting systems have improved the appearance of such graphic designs in carpets. In addition, artificial or synthetic grass or turf products also have been growing in popularity and demand, especially for use in indoor stadiums and in areas where grass fields are difficult to maintain due to weather conditions. Such synthetic turf products more recently further are being formed as tufted products having synthetic turf yarns or filaments that simulate blades of grass tufted into a backing material, with a fill material, such as ground up tires, sand, and/or other particulate matter, generally being applied between the tufts of the synthetic grass filaments to help support the tufts and cushion the turf. It is also desirable to form such turf products with desired color variations and/or patterns (such as logos or checked patterns) to avoid the need for painting or later forming such as markings or graphics.

In the past, the method of forming desired graphic patterns or designs such as logos, numbers or other features in tufted turf products generally has involved installing the plain turf at a site, then placing a template on the installed turf and shearing off the yarns within the template to create a space. A pre-cut logo, number or other design having the desired color is then glued into place over the sheared area or space. Understandably, such a process is often very labor and time intensive, and accordingly is expensive and can lead to significant material waste in terms of the sheared and removed yarns. Inaccuracies and issues with the alignment and retention of such glued-in logos or other intricate designs also can arise.

The resultant synthetic turf or grass fabric also importantly must meet desired standards for cushioning, support, ball bounce, ball roll, and the amount of fill, especially where it is installed in sanctioned athletic fields, such as for professional, college, and high school sports facilities. For example, FIFA, the governing body for international soccer has very specific standards for the amount of cushioning and support, as well as for ball bounce and the amount of fill that can be used in sanctioned synthetic turf soccer fields. There consequently is a continuing need to try to improve the cushioning, support and playability of synthetic turf fields, and to reduce the amount of fill or particulate matter needed to support the synthetic turf or grass filaments, which particulate matter often can get in players' eyes, etc., as it is disturbed during play, to improve the players' comfort and help reduce injuries as much as possible.

Accordingly, it can be seen that a need exists for a system and method for forming patterned tufted products, including artificial/synthetic grass or sports turf materials that address the foregoing and other related and unrelated problems in the art.

SUMMARY OF THE INVENTION

Briefly described, the present invention generally relates to a system and method for forming patterned tufted fabrics, including carpets or other similar articles having varying pile heights and/or utilizing loop pile and/or cut pile tufts. In one example embodiment, the patterned tufted fabrics formed using the system and method of the present invention can be formed from various types of yarns, including synthetic grass or turf type filaments or yarns inserted into a backing material to form patterned artificial/synthetic grass or turf products. The present invention generally is adapted be utilized in a tufting machine including at least one row of needles positioned along a tufting zone of the tufting machine. The needles can be arranged in an in-line or staggered configuration, and can be mounted along one needle bar, or can be positioned in multiple rows spaced in series along one or more reciprocating needle bars. Each of the needles generally includes a pick up area and carries a filament or yarn for introduction of the yarns into a backing material as the backing material is moved through the tufting zone. The needles further can include multiple pick-up areas formed at different elevations or heights therealong; for example, including a first or lower pick-up area and a second or upper pick-up area, and can be of varying lengths.

A gauging element assembly is located below the tufting zone. In one embodiment, the gauging element assembly generally can include a series of level cut loop ("LCL") loopers or hooks mounted at a first elevation below the backing material, along a first side (e.g., a downstream side) of the tufting zone and reciprocated into and out of engagement with an associated pick-up area (i.e., a first pick-up area) of their corresponding needles upon penetration of the backing material by the needles so as to pull and capture loops of yarns from the needles. In another embodiment, a series of loop pile loopers further can be positioned along a second (e.g., an upstream) side of the tufting zone opposite the LCL loopers. The loop pile loopers further can be located at a different elevation from the LCL loopers (e.g., a second or higher elevation) and generally will be movable into engagement with an associated pick-up area (i.e., a second pick-up area of a different elevation from the first pick-up area) of their corresponding needles, so as to pick up and pull loops of yarns therefrom to form a second series of tufts, i.e., loop pile tufts in the backing material.

The tufting machine also generally will include a main driveshaft which drives the reciprocation of the needles into and out of the backing material, backing feed rollers which feed a backing material through the tufting zone, and one or more yarn feed mechanisms arranged along an upstream and/or a downstream side of the tufting zone. A system controller including an operator input device typically will receive pattern instructions, including LCL pattern instructions, and will control operation/activation of the LCL loopers to engage and form tufts of selected yarns in the backing material.

Each of the LCL loopers can include an elongated body having a throat terminating in a hooked front end or barb adapted to engage a corresponding pick-up area (i.e., the first or lower pick-up area) of their associated needles. A series of clips can be movably mounted along the bodies of the LCL loopers, the proximal or first ends of which can be connected to a series of actuators that control movement of each clip between a first, home or retracted position and a second, extended blocking position. Each of the clips further can include a second or distal end having a configuration adapted to engage and block, enclose or otherwise cover the barb of their associated LCL loopers to prevent or retard the pick-up and/or capture of loops of yarn along the throat portions of the LCL loopers. The LCL loopers further typically will include a series of knives that will be reciprocated into engagement with the loops of yarns collected on the LCL loopers to form cut pile tufts within the backing material. The LCL loopers or hooks can be operated to perform a controlled cut operation, whereby if the LCL loopers pick up a yarn, a cut pile tuft generally can be formed, while selective actuation of the LCL looper clips generally will block capture of yarns along the LCL loopers so that a cut pile tuft is not formed.

Each loop pile looper can include an elongated body having a first or proximal end, and a throat extending toward the tufting zone and terminating in a pointed bill or second, distal end. The loop pile loopers can be reciprocated toward and away from the needles, for example, by a cammed motion linked to the same driveshaft as the LCL loopers and operated in timed relation to the main shaft of the tufting machine. Alternatively, the loop pile loopers can be driven by a separate, servo-driven cammed drive mechanism, to enable adjustment or variation of the reciprocation of the loop pile loopers in relation to the reciprocating movement of the LCL loopers. In addition, the loop pile loopers can be maintained out of engagement with the needles as needed depending on the pattern operation being run.

In one example embodiment, the needles can be provided with a series of different color or type filaments or yarns as needed for forming different patterns within the backing material, such as forming colored pattern effects therein. The yarns can be fed to needles that are arranged in groups or sets for presentation of different color or type yarns to a series of defined stitch areas or pattern pixel locations. Each stitch area or pixel can be of a size or area defined by a desired number of needles and/or a desired grouping or set of colors of yarns carried therewith, arranged at a prescribed or desired gauge of the tufting machine. For example, for a 1/10 gauge machine running multiple colors, with the needles grouped in sets or arrangements of 2-4 yarns or more (i.e., 5, 6, etc.), such as by type or color, the prescribed stitch areas or pattern pixels each can cover an area of approximately 2/10-4/10 of an inch (i.e., 1/10 of an inch multiplied by the number of needles and/or colors of yarns (2-4) in each prescribed needle group of each pixel. Greater or lesser spacings for each defined pixel or stitch area also can be used, depending on the number of needles being grouped together and spacings therebetween to define a desired size pixel, and/or the number of yarns or colors of the pattern which will be fed to the needles associated with each defined pixel.

In one embodiment of operation of the present invention, each of the yarns being carried by each needle set of the defined or selected pixels or stitch areas will be presented into the backing material with the reciprocation of the needles. As the needles penetrate the backing material passing through the tufting zone, the LCL loopers are reciprocated toward their pick-up position, engaging the associated pick-up areas of their corresponding needles. The actuation of the clips of the LCL loopers will be controlled in accordance with programmed LCL pattern instructions to determine which selected yarns of the group of yarns presented at each of the pixels are to be picked up by the LCL loopers. The system controller, operating the programmed LCL pattern instructions, will activate the LCL loopers corresponding to the selected yarns, causing clips thereof to move to their extended or blocking positions wherein the barbs at the ends of their LCL loopers will be closed or covered to control formation of tufts of yarns (e.g., cut pile tufts) thereby. The selected LCL loopers thus will be prevented from capturing yarns from their associated needles as the LCL loopers are reciprocated out of engagement with the needles.

In one embodiment, the selection of yarns to be retained at each prescribed pixel or stitch area can be determined or enabled by operation of the LCL clips to cause the LCL pattern loopers to pick up or not pick up selected and non-selected yarns, respectively. The yarn feed mechanism(s) accordingly will be controlled by the system controller in accordance with the programmed LCL pattern and operation of the LCL looper clips so as to pull back or otherwise control feeding of the non-selected yarns so that the yarns can be pulled low or out of the backing material and allowed to float along the rear surface of the backing material and thus remain hidden. The retention of the selected yarns at each pixel or stitch area enables various graphic colored patterns to be formed in the backing material, such as, for example, the formation of checked patterns of different colors, or formation of stripes, logos, side/yard lines and/or other field markings for the resultant sports turf or artificial turf products.

Alternatively, the loop pile loopers also can be reciprocated into engagement with the needles, engaging the second or upper pick-up areas of each of the needles, and can pick-up the non-selected yarns from the needles to form loop pile tufts within the backing material. In such an embodiment, the clips of the LCL loopers can be engaged in accordance with a programmed LCL looper pattern profile to determine which selected yarns are to be retained as high or cut pile tufts, such that, if the yarn carried by a needle is selected for pickup by the LCL loopers, the selected yarn will be engaged and captured along the throat of the LCL looper, while the corresponding loop pile looper can reciprocate into and out of engagement with the needle without picking up the yarn. However, for the non-selected yarns presented at each pixel or stitch area, which will be blocked from pick-up and/or capture by their LCL loopers, such yarns consequently can be picked up by the throats of the loop pile loopers as the needles are reciprocated out of the backing material, so as to additionally enable formation of loop pile tufts of these non-selected yarns within the backing material as needed or desired.

The yarn feed mechanism(s) further can be operated to control the pile height of the loop pile tufts being formed within the backing material by the loop pile loopers. Thus, the yarns forming the loop pile tufts can be formed at or pulled to a low or back-robbed pile height, including pulling the yarns out of the backing material if needed or desired. Alternatively, loop pile tufts of a desired height also can be formed between the cut pile tufts being formed by the LCL loopers as needed or desired, for example, to reduce the amount of backfill required in a tufted turf product and/or to provide additional support for the cut pile tufts formed therein.

Various features, objects and advantages of the present invention will become apparent to those skilled in the art upon a review of the following detailed description of the invention, when taken in conjunction with the accompanying drawings.

Figure 1:
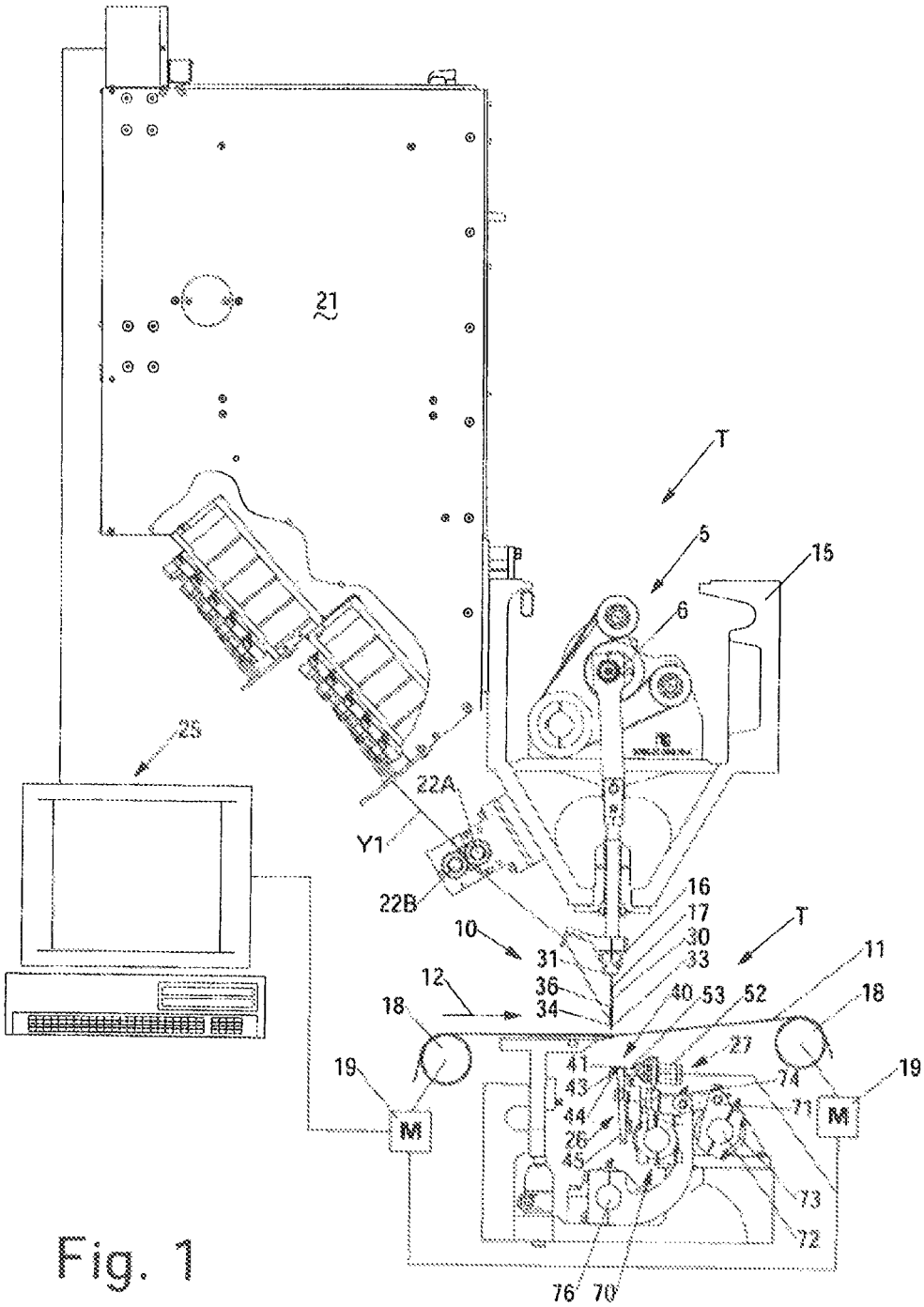
FIG. 1 is a side elevational view illustrating one embodiment of a tufting machine for use in forming patterned tufted articles including artificial/synthetic sports turf products according to the principles of the present invention.

It will be understood that the drawings accompanying the present disclosure, which are included to provide a further understanding of the present disclosure, are incorporated in and constitute a part of this specification, illustrate various aspects, features, advantages and benefits of the present disclosure and invention, and together with the following detailed description, serve to explain the principals of the present invention. In addition, those skilled in the art will understand that, accordingly, in practice, various features of the drawings discussed herein are not necessarily drawn to scale, and that dimensions of various features and elements shown or illustrated in the drawings and/or discussed in the following Detailed Description may be expanded, reduced or moved to an exploded position in order to more clearly illustrate the principles and embodiments of the present invention as set forth in the present disclosure.

DETAILED DESCRIPTION OF THE INVENTION

Referring now in greater detail to the drawings in which like numerals indicate like parts throughout the several views, the present invention generally relates to a method and system for forming patterned tufted fabrics which can include multiple color graphic patterns. In one example embodiment described herein the present invention provides a system and method of tufting patterned articles that can have cut, loop, or loop pile and cut pile tufts of synthetic grass filaments or yarns formed therein for forming various artificial/synthetic grass or turf products. As illustrated in FIGS. 1-5, a tufting machine T utilizing the present invention generally will include a tufting zone 10 through which a backing material 11 is fed, as generally indicated by arrow 12 for the introduction of yarns (shown by dashed lines Y1, et. seq.,) into the backing material. The placement of each yarn further will be controlled, wherein the yarns can be presented in groups or sets to a series of pixels or stitch locations of the pattern being run, with selected yarns being retained at each pixel, while the remaining, non-selected yarns presented at each pixel or stitch location can be pulled low or out of the backing material or can be otherwise controlled so as to hide such non-selected yarns along the face of the finished tufted article as needed.

As indicated in FIG. 1, the tufting machine T generally can comprise a tufting machine such as disclosed in U.S. Pat. Nos. 5,979,344, 7,096,806 and/or 7,359,761, the disclosures of which are incorporated by reference as if fully set forth herein. The tufting machine T generally will include a frame 15 on which is supported a machine drive 5, including a main drive shaft 6 that reciprocally drives at least one reciprocating needle bar 16 carrying one or more rows of needles 17 mounted in spaced series therealong. The backing material 11 is fed through the tufting zone 10 by upstream and downstream backing rolls 18 driven by motors 19 and is engaged by the reciprocation of the needles. While a single needle bar 16 with a row of in-line needles 17 generally is shown in the embodiments illustrated in FIGS. 1-4B, it will be possible to utilize a single needle bar with multiple in-line or staggered rows of needles. As a further alternative, multiple needle bars, having rows of needles therealong also can be used, for example, as illustrated in FIG. 5 and discussed below. A series of yarns, indicated by Y1 et seq., (FIGS. 1-4B) are fed from one or more yarn feed mechanisms or devices 21, typically pulled between pairs of puller rolls 22A and 22B and through a yarn guide 23, to each of the needles 17.

In addition, a system control 25, such as a Command Performance Tufting Machine Control as manufactured by Card-Monroe Corp. is linked to the yarn feed, backing feed motors, main drive shaft motors 19, gauging element assembly 26 and other operative systems/elements of the tufting machine, as indicated in FIG. 1. The system control includes an operator input such as a keyboard or touch screen, and can be networked to other controllers. The system control can receive pattern instructions and will control the various operative elements of the tufting machine T including the backing feed, the gauging assembly 26 of the tufting machine and the yarn feed mechanisms controlling the feeding of the yarns to the needles to form the desired graphic patterned tufted articles.

The yarns Y1, et. seq., used to form a tufted turf fabric in accordance with the principles of the present invention generally can include synthetic grass filaments or other material filaments, yarns as commonly used for such turf fabrics, carpets, and/or other tufted fabrics. The yarns generally are fed to the needles 17 from the one or more yarn feed mechanisms 21 and are inserted into the backing material 11 as the needles penetrate the backing 11, whereupon the yarns will be engaged by the gauging element assembly 26 of the tufting machine T in order to form tufts of selected ones of the yarns within the backing material in accordance with the pattern instructions programmed into or received by the system control. The yarn feed mechanism(s) can include scroll, roll, servo-scroll, single-end yarn feed, double-end yarn feed and/or other types of pattern and non-pattern yarn feed devices, such as an Infinity™, Infinity IIE™ or Yarntronics™ yarn feed system or mechanism as manufactured by Card-Monroe Corp. for controlling feeding of the yarns to form various pattern effects in the finished tufted turf fabrics.

As illustrated in FIGS. 7A-8D, in each of the needles 17 generally will include an elongated shank or body 30 having an upper end 31 received in or along the needle bar 16 (as indicated in FIGS. 1-5), or within a module (not shank) attached to the needle bar, and a distal or second end 32 that terminates in a pointed tip 33. In the embodiment of the needles illustrated in FIGS. 1-7D, the needles generally will be provided with at least one, i.e., a first, pick-up area 34 formed adjacent the distal end 32 of each needle, and further can include a second or upper pick-up area 36 located adjacent or above the first pick-up area at a desired elevation. As a result, the needles can be engaged at the first and second pick-up areas by opposed gauge parts 27 of the gauging assembly 26 as the needle penetrates the backing material, as indicated in FIGS. 7A, 7C and 8A and 8C. An eye or similar opening generally is formed adjacent the pointed tip 33 of each needle and receives a yarn therethrough. As the needles are engaged by the gauge parts 27 of the gauging assembly 26, the yarns can be selectively picked and pulled or otherwise removed from their needle by at least one of the opposed gauge parts reciprocated into engagement therewith to form tufts of yarns in the backing material as needed in accordance with the programmed pattern instructions.

Alternatively, the needles can be formed with a more conventional construction, as illustrated in FIGS. 8A-8D. In such a construction, the needles can be formed with only one pick up area, i.e., the first or lower pick up area 34 and generally will be engaged by gauge parts (here shown as level cut loopers 40) only along one side of the tufting zone. Thus, the tufting machine may not include opposing gauge parts or gauge parts on both sides of the tufting zone, and/or if such gauge parts are provided, they can either be maintained out of engagement with the needles, or simply can pass by the needles. Still further, the upstream or opposing gauge parts, if used, also could engage the second pick-up areas of the needles, as shown in FIGS. 7A-7D. as they are reciprocated without picking up yarns from the needles.

Figure 4A:
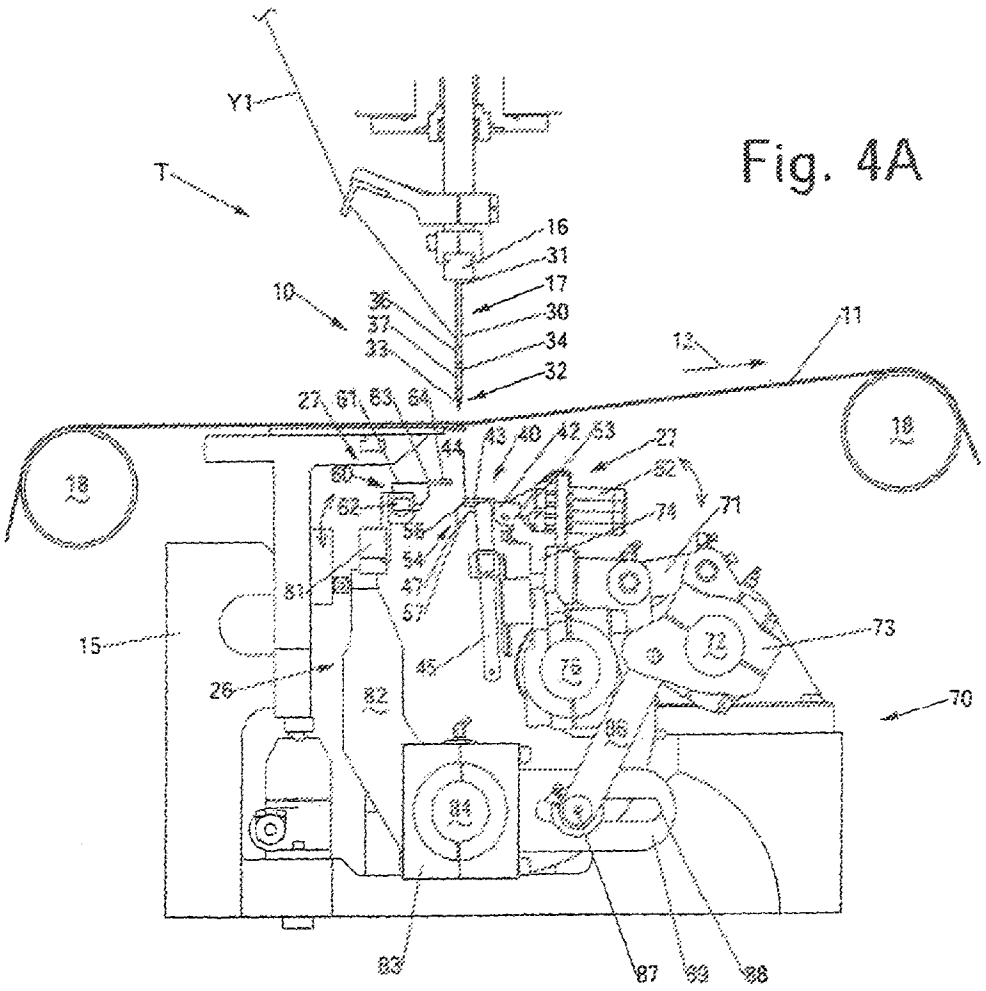
FIGS. 4A-4B are side elevational views of the tufting zones of the tufting machines of FIGS. 2A-3B.
Figure 4B:
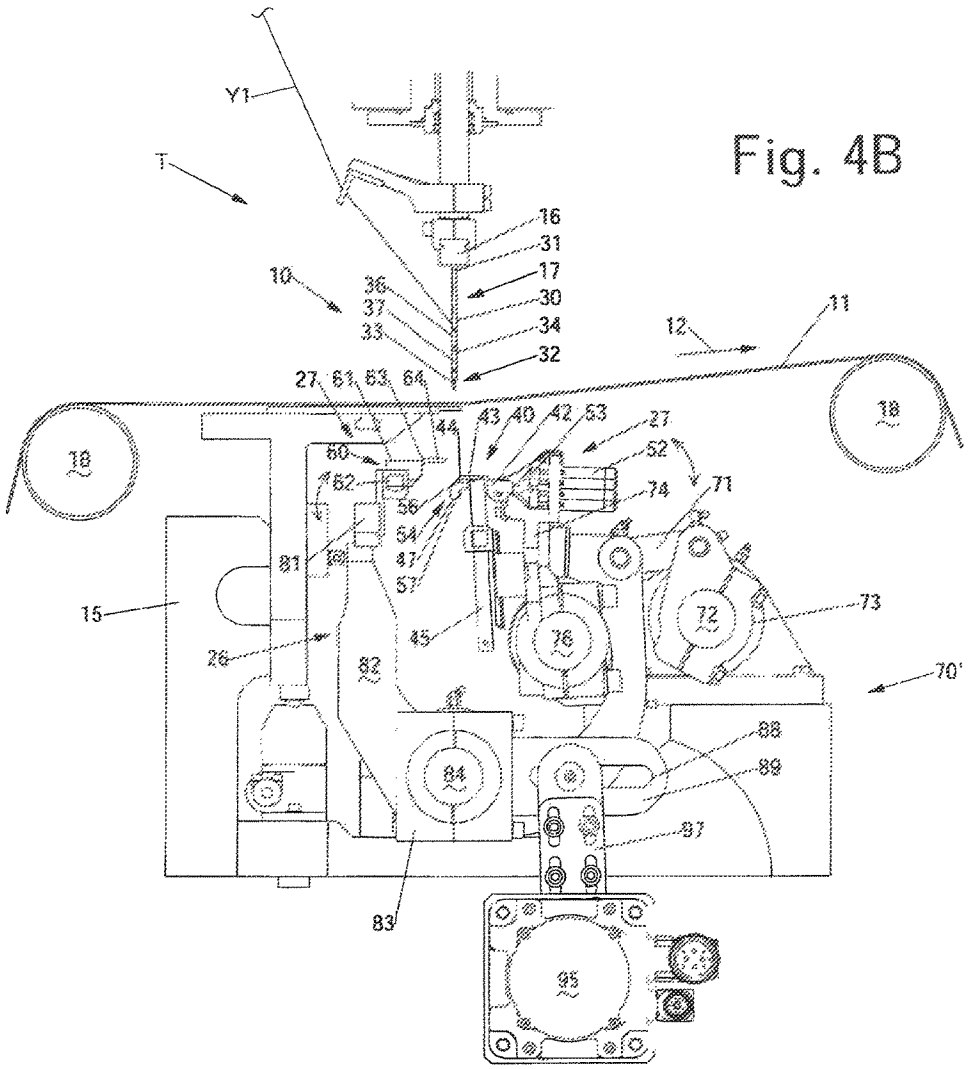
Figure 5:
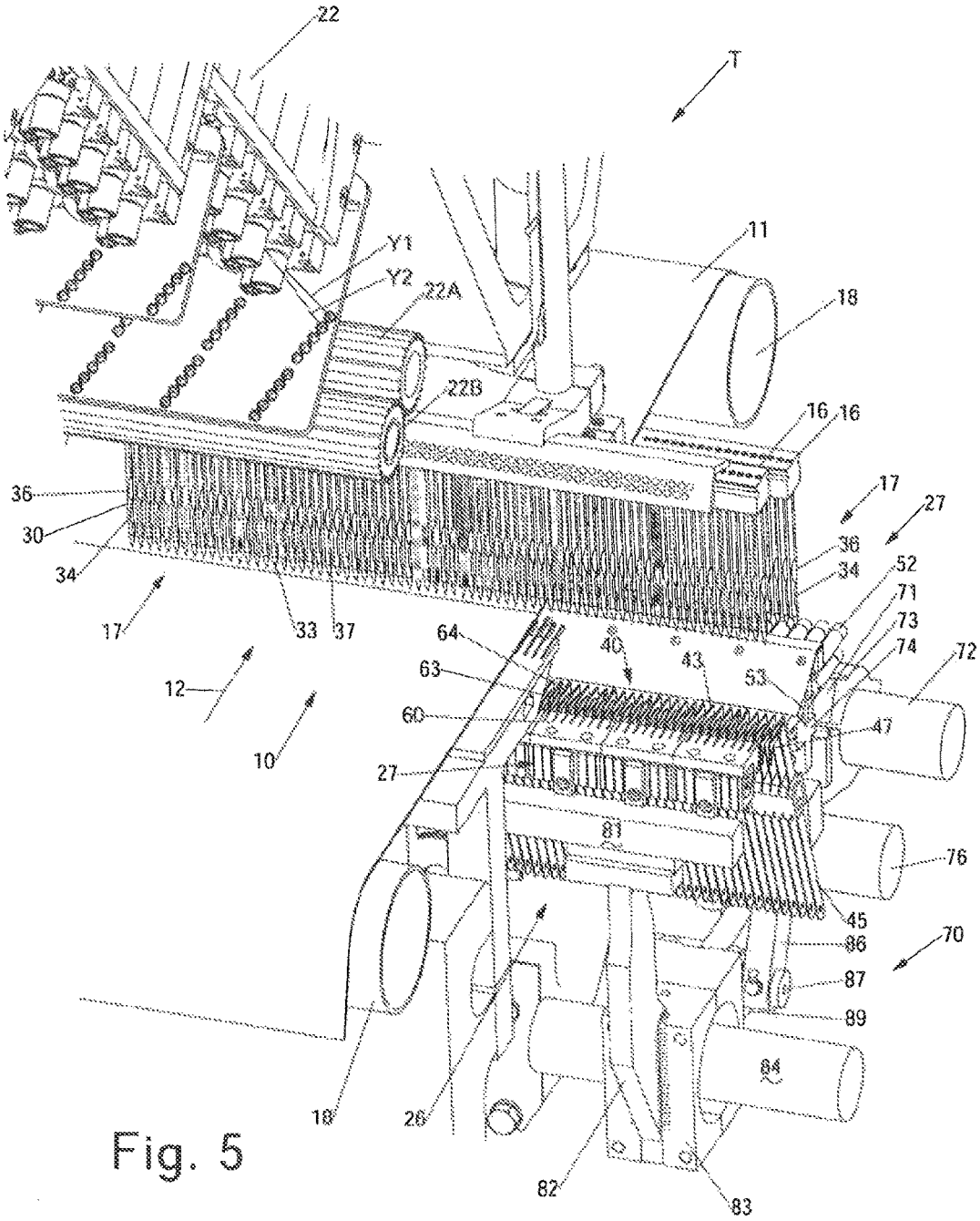
FIG. 5 is a perspective illustration of another example embodiment of a tufting machine according to the principles of the present invention.
Figure 6B:
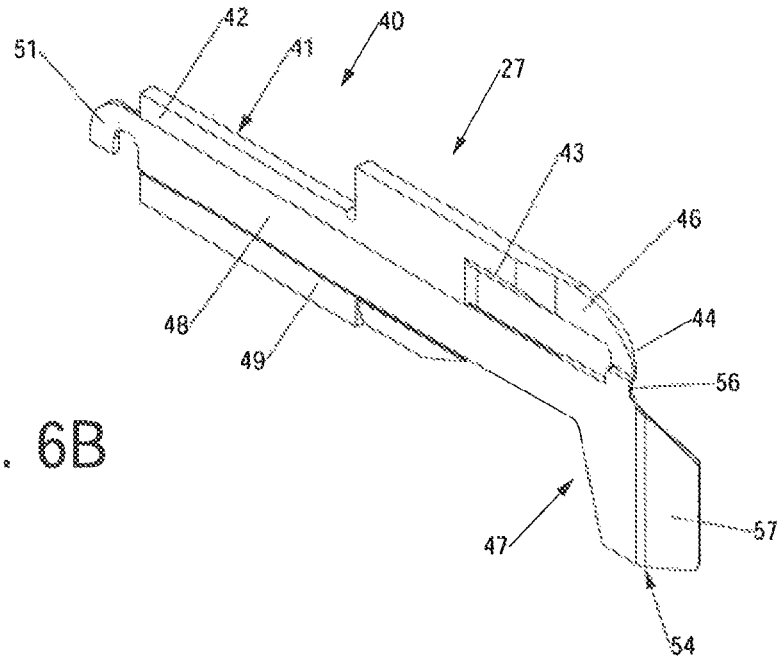
FIGS. 6A-6B are perspective illustrations of one embodiment of a level cut loop looper for use with the tufting machines of FIGS. 1-5, illustrating the movement of the clip thereof between its first, retracted position and its second, extended or blocking position.
Figure 6A:
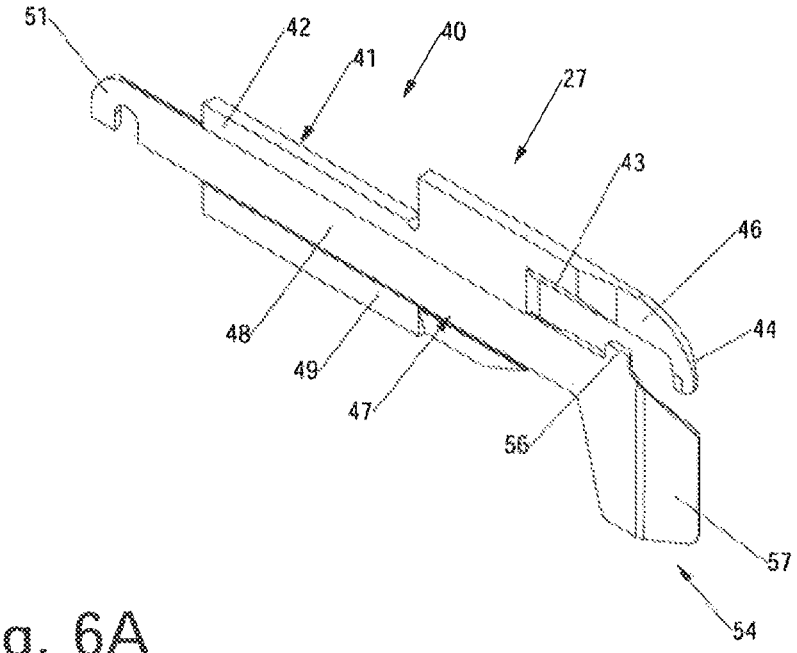

In one embodiment, as illustrated in FIGS. 1-5, the gauge parts 27 of the gauging assembly 26 generally can include first and second or downstream and upstream gauge parts. For example, a series of level cut loop ("LCL") loopers or hooks 40, can be mounted along a downstream side at the tufting zone 10, located at a first elevation or position below the backing material, and will be reciprocated toward and away from engagement with the needles 17. FIGS. 6A-6B illustrate an example embodiment of an LCL looper 40 for use in the present invention. In this embodiment, the LCL loopers 40 each generally include an elongated body 41 having a rear or shank portion 42 and a forwardly extending throat portion 43. The throat 43 of each LCL looper generally terminates at a hooked end or barb 44, which further can include beveled or contoured surfaces 46 along the hooked forward ends 44 and throats 43 of the LCL loopers, at which knives 45 (FIGS. 7A-7D) associated with each of the LCL loopers can be reciprocated into engagement therewith to cut the loops of yarns for forming at pile tufts.

Each LCL looper further will include a movable clip 47 (FIGS. 6A-6B), typically having an elongated body 48 that is received and slides along a passage or channel 49 defined within the shank 42 of its LCL looper body 41. Each clip typically will include a first or proximate end 51 that can have a hooked configuration, or be otherwise configured to engage and be linked with an actuator 52 via a gate or connector 53 as illustrated in FIGS. 4A-4B, and a second or distal end 54. As indicated in FIGS. 2A-4B, the actuators 52 can include a series of hydraulic or pneumatic cylinders, solenoids or other, similar actuators as will be understood by those skilled in the art. The actuators will be controlled by the tufting machine system control 25 (FIG. 1) in accordance with a programmed LCL pattern to control the firing or activation of each actuator as needed to cause each of the clips of the corresponding LCL loopers to be moved from their first, retracted positions to their second, extended or blocking positions to selectively control the pick-up of yarns from the needles by the LCL loopers for retention of selected yarns presented at or within each pattern pixel. The feeding of the yarns also can be controlled to cause the non-selected yarns presented at each pixel or stitch area to be pulled low or out of the backing material as needed.

As further illustrated in FIGS. 6A-6B, the second or distal ends 54 of each of the clips 47 generally can be configured so as to substantially enclose or block the LCL loopers 40 from capturing and/or retaining loops of yarns from their associated needles along the throat portions 43 of the LCL loopers. By way of example, as illustrated in FIGS. 6A and 6B, the distal ends of the clips can include an upwardly extending projection or tab 56 that can engage a surface 46 of the hooked end or barb 44 of its associated LCL looper for substantially closing off or blocking access to the throat 43 thereof. The distal ends of the clips further can include a forwardly projecting tongue or portion 57 that can extend past the hooked end of its LCL looper and can have a slanted or other configuration to facilitate movement of the LCL looper and clip past its associated or corresponding needle upon engagement therewith, as indicated in FIGS. 7A-7C.

In one embodiment of the present invention illustrated in FIG. 1, the tufting machine T can be operated using the LCL loopers to form the desired pattern effects within the tufted fabric article such that a downstream or secondary row of gauge parts (as is shown in FIGS. 2A-4B) are not necessary. In such a system, operation of the LCL loopers and selective movement of the clips thereof to their blocking positions can enable or determine and thus control the selection and retention of desired colors or ones of the yarns presented at each pixel or stitch location of the pattern. Alternatively, as indicated in FIGS. 2A-4B and 7A-8D, a secondary set or row of gauge parts 27 can be provided, and, as indicated in FIGS. 7A-7D, can be operated to engage the needles to pick up and form loops of the non-selected yarns that are not picked up by the LCL loopers, as needed or desired.

As illustrated in the figures, the secondary set or row of gauge parts 27 can generally can include a series of loop pile loopers 60 typically arranged in an opposed facing relationship on the opposite side of the tufting zone from each of the LCL loopers (i.e., along an upstream side of the tufting zone 10), which further generally can be spaced vertically above or otherwise located at a different elevation (typically above) from the LCL loopers. Each loop pile looper generally includes a body 61 having a shank 62 and a forwardly projecting throat 63 terminating in a pointed distal end or bill 64. The loop pile loopers can be reciprocated toward and away from the tufting zone as the needles penetrate/move through the backing material and can engage the second or upper pick-up areas 36 of their associated needles 17, as indicated in FIGS. 7A-7D. Depending on whether the LCL looper picks up and retains a yarn from its needle, or is blocked from retaining the yarn carried by its needle, each loop pile looper can be reciprocated out of engagement with its corresponding needle without picking up the yarn (i.e., if the LCL loopers do pick up the yarns), or can capture and pull a loop of yarn from its needle (i.e., where the yarn is not selected and retained by the corresponding LCL looper). Thereafter, such loops of yarns can be pulled low or out of the backing material by control of the feeding of the yarns therefor, or can be maintained to follow loop pile tufts of a desired height.

Figure 2A:
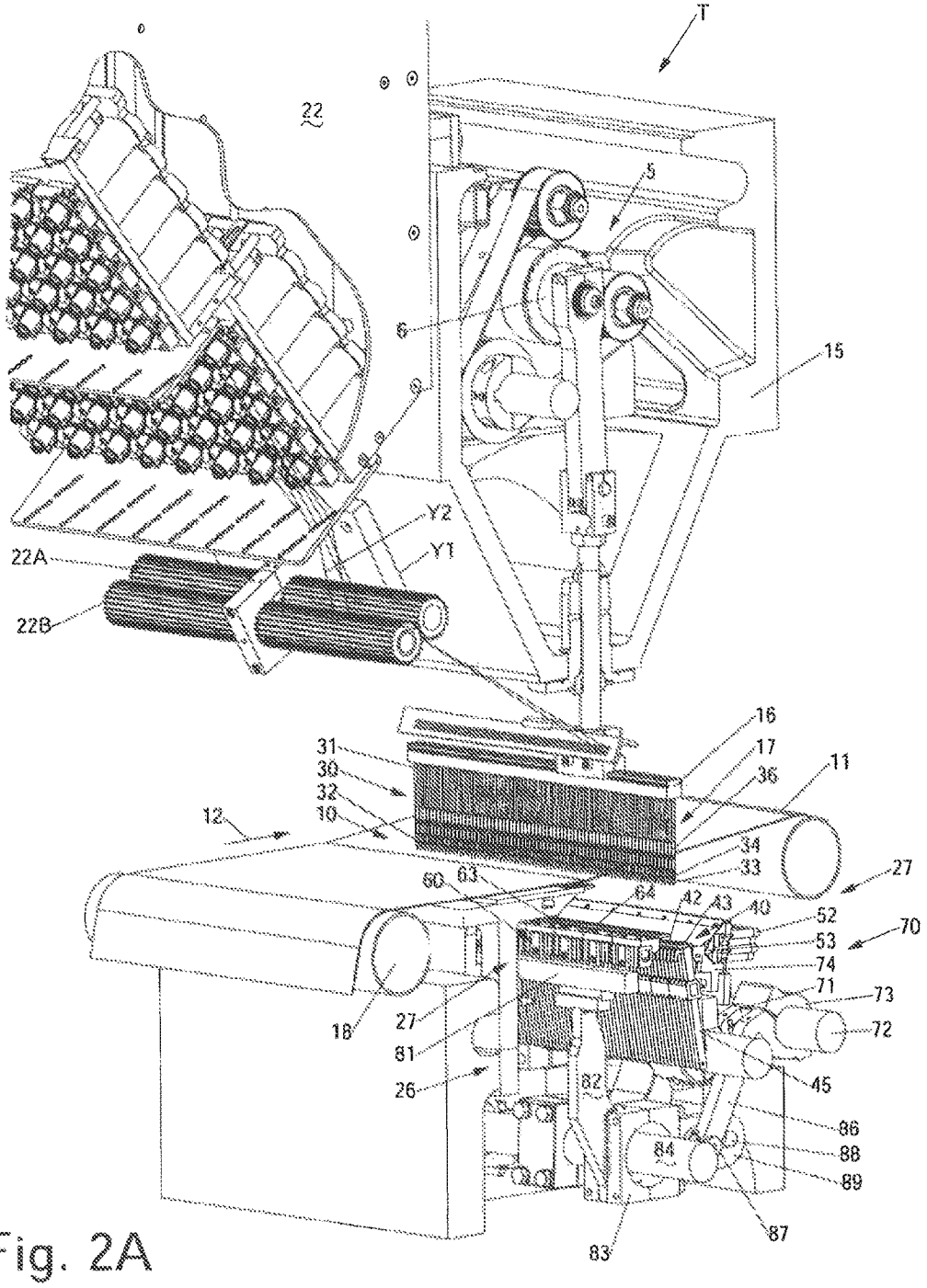
FIGS. 2A-2B are perspective illustrations of further embodiments of a tufting machine according to the principles of the present invention, each illustrating different drive systems for driving the gauge parts of the gauging assembly of the tufting machine.
Figure 3A:
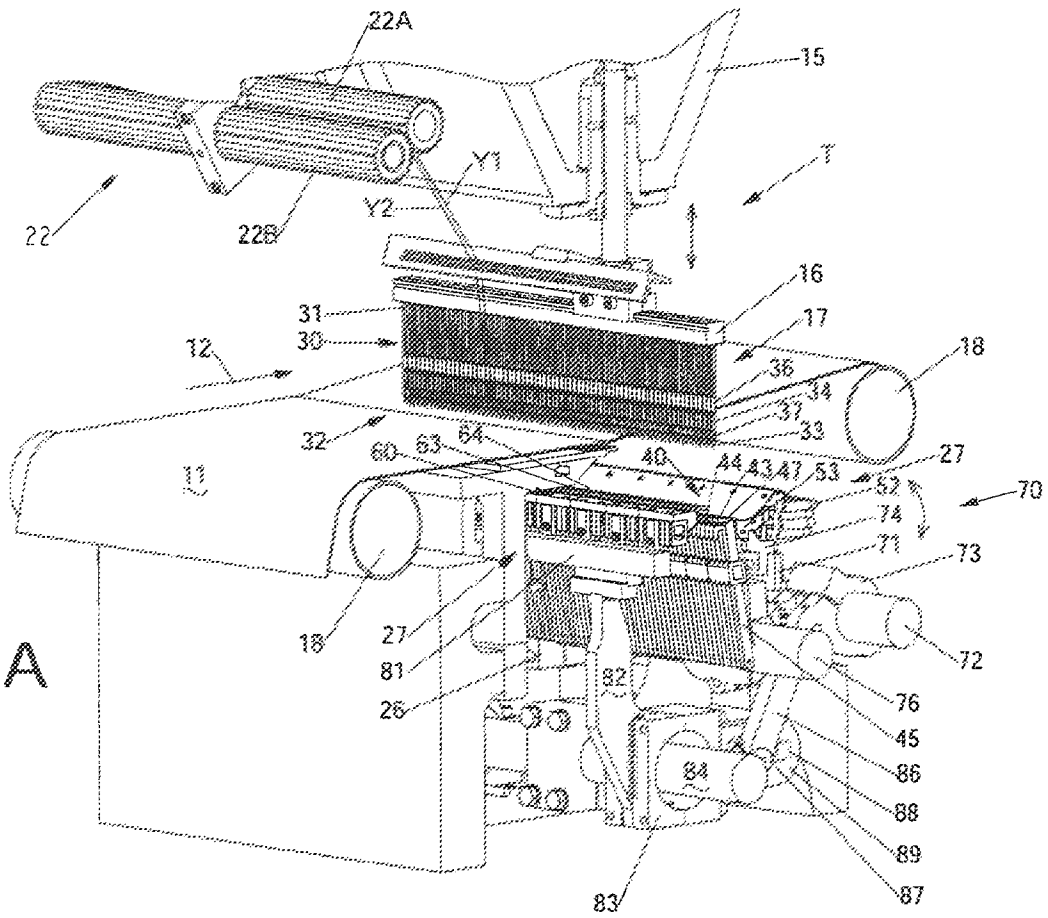
FIGS. 3A-3B are further perspective illustrations of the tufting zones of FIGS. 2A-2B, respectively.

The system and method of forming artificial/synthetic sports grass or turf fabrics according to the present invention generally can utilize a drive system 70 or configuration for driving the gauging assembly 26 that is similar to a "Velv-a-Loop" tufting machine configuration, such as indicated in the attached FIGS. 2A, 3A and 4A, and as shown in U.S. Pat. No. 7,946,233, the disclosure of which is incorporated herein as if set forth in its entirety; and with the lengths of yarns fed from the yarn feed device(s) being controlled to accommodate the engagement and pulling of yarns from the needles by the corresponding LCL loopers/hooks and the loop pile loopers (as needed) without excess yarns being accumulated above the backing material. Additionally, other machine configurations, systems and arrangements of loopers, hooks and other gauge parts also can be used, such as shown in U.S. Pat. No. 7,438,007, the disclosure of which is incorporated herein by reference as if set forth in its entirety.

As indicated in FIGS. 1-5, the gauging assembly 26 of the tufting machine T of the present invention can be driven by various types of drive systems 70. For example, as shown in FIG. 1, where only LCL loopers or hooks are used, the LCL loopers 40 each can be driven off the main driveshaft 6 of the tufting machine via cammed linkage arms 71 connected to and operating off a jackshaft or rocker shaft 72 that is linked to the main driveshaft of the tufting machine in an operative, driven relationship, as will be understood by those skilled in the art. The linkage arms 71 are connected to the rocker shaft 72 by a bracket 73 at one end, and at their opposite ends to a hook bar 74 or other support along which the LCL loopers 40 are mounted. The hook bar further can be connected to a pivoting shaft 76, to which the knives 45 associated with each LCL looper likewise are connected or mounted, for driving the reciprocating motion of the knives into engagement with their LCL loopers for cutting loops of yarns captured thereon to form cut pile tufts in the backing material.

Alternatively, as indicated in FIGS. 2A, 3A and 4A, where loop pile loopers 60 are also provided, the drive system 70' can operate to drive the loop pile loopers by operation of the same rocker shaft 72 as the LCL loopers 40, such as in a "Velv-a-Loop" type drive arrangement or mechanism. With such a drive system, the loop pile loopers can be mounted along a hook bar or other support 81 that is attached via a series of support or lever arms 82 to journal blocks 83 mounted along an idler shaft 84. The journal blocks 83 in turn can be connected to a corresponding one of the brackets 73 mounted along the rocker shaft 72 of the LCL drive system via link arms 86. Each link arm 86 also typically can have a cam roller 87 mounted along a lower end thereof, which can roller can engage and move along a slot or cam groove 88 of a cam arm or projection 89 attached to each journal block.

The loop pile loopers accordingly will be driven in a timed relationship with the reciprocation of the LCL loopers so that the loop pile loopers can be reciprocated into engagement with the upper or second pickup areas of their associated needles, for example, engaging the needles at or approximately near the same time that the LCL loopers are engaging the first or lower pickup areas of the needles. Adjustment of the link arms and the amount of travel of their cams along the slots of the journal blocks can enable variation of the movement of the loop pile loopers, both in terms of timing of the reciprocation of the loop pile loopers in relation to the reciprocation of the LCL loopers, as well as adjustment of the throw or range of movement of the loop pile loopers as they are reciprocated toward and away from the needles. The reciprocation of the loop pile loopers also can be adjusted and further varied so that they can be maintained substantially out of contact with the needles if needed or desired.

Figure 2B:
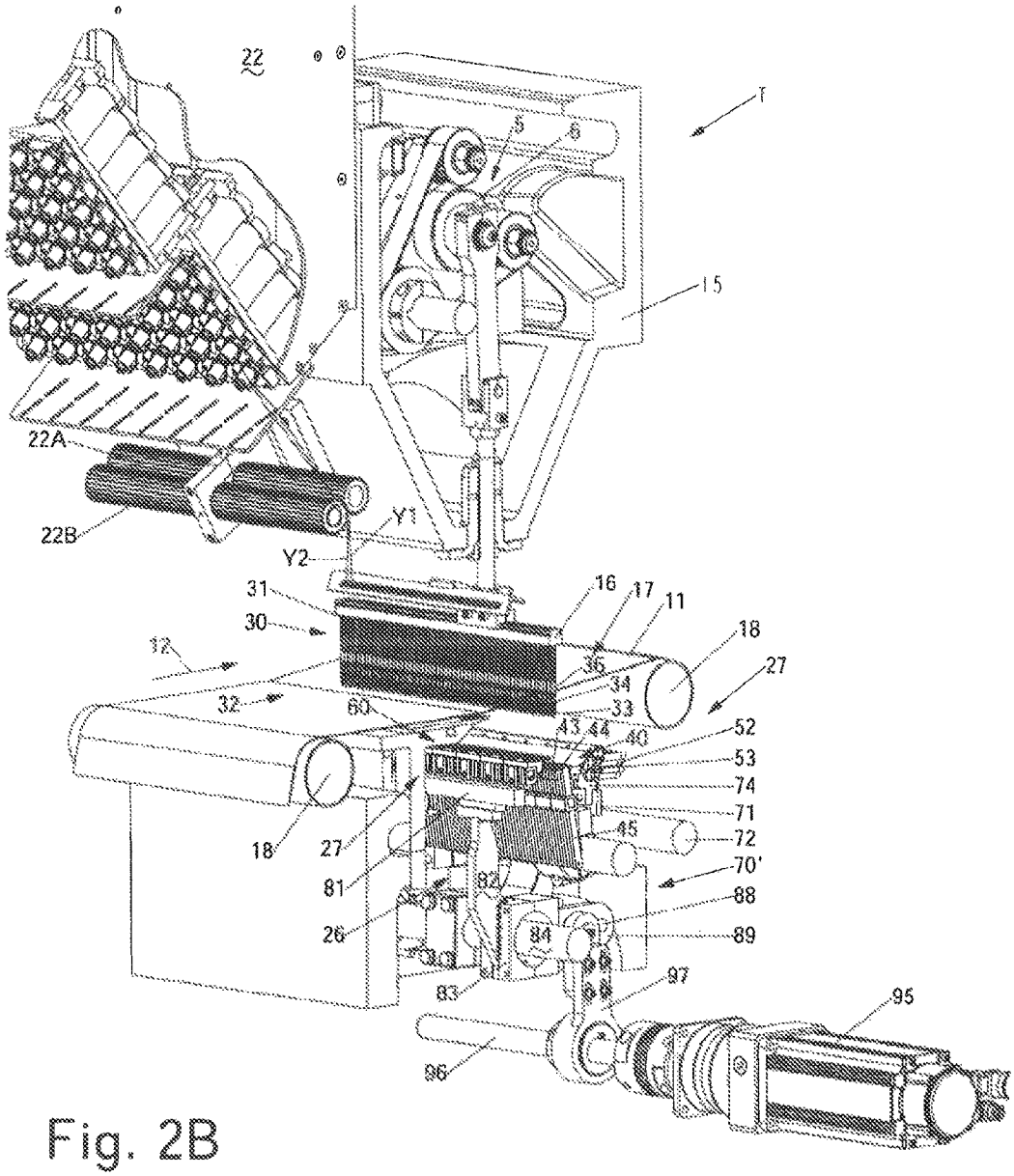
Figure 3B:
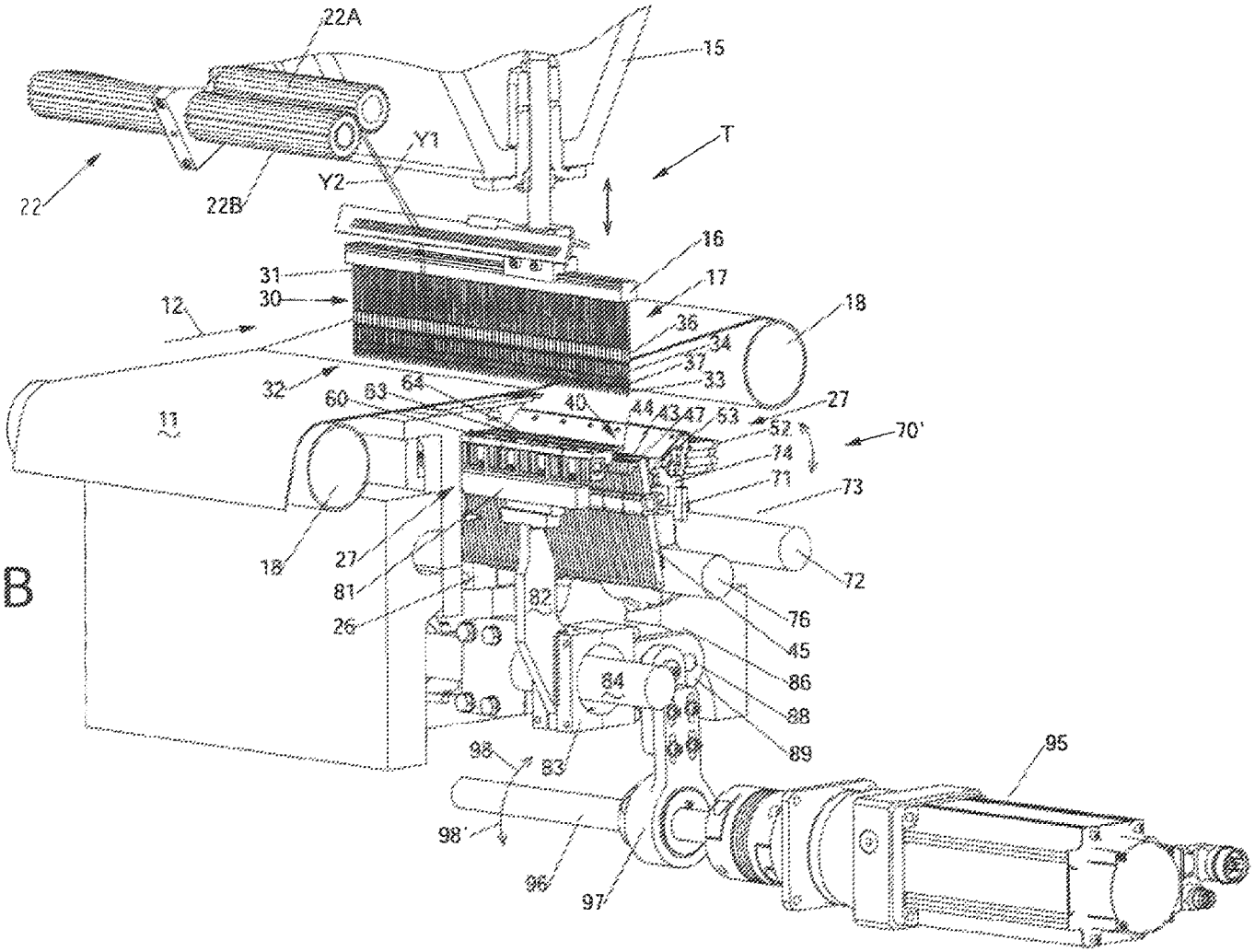

FIGS. 2B, 3B and 4B illustrate still a further alternative embodiment for a drive system 70' for use in driving the LCL loopers and/or the loop pile loopers to form the patterned tufted fabrics in accordance with the principles of the present invention. In this embodiment, the drive system 70' can include a servomotor 95 or similar independent drive mechanism that is not directly tied to the operation of the main shaft of the tufting machine. Instead, the servomotor 95 can be controlled directly by the system control in accordance with the LCL pattern instructions programmed or received therein for controlling the loop pile loopers to form loop pile tufts of yarns in the backing material 11. The servomotor 95 can include a drive shaft 96 and an internal motor control that can monitor the operation of the servomotor and provide feedback to the system control, or can include a separate control mechanism for controlling operation and monitoring/receiving feedback from the servomotor. The operation of the servomotor thus can be controlled and varied for driving the loop pile loopers independently of the operation of the main drive shaft of the tufting machine.

A series of adjustable straps 97 having cams 98 mounted to a distal or free end thereof (only one of which is shown in the drawings for clarity) can be mounted at spaced intervals along the length of the drive shaft 96 of the servomotor 95 for connecting the drive shaft to corresponding journal blocks 83. As indicated in FIGS. 3B and 4B, the cams 98 typically engage the journal bearings along the cam slots 88 of the slotted arms 89 thereof. The drive shaft of the servomotor generally can be reciprocated along a desired arcuate path of movement, in the direction of arrows 98 and 98' (FIG. 3B), which in turn causes movement of the journal block 83 in a reciprocating fashion, so as to reciprocate loop pile loopers toward and away from the needles, while the LCL loopers generally can continue to be operated off of the main shaft. As a further alternative, the rocker shaft 72 that drives the reciprocation of the LCL loopers also can be driven off of a separate servomotor (not shown) or other, similar independent drive mechanism.

The use of the independent drive mechanism such as servomotor 95 for driving reciprocation of the loop pile loopers can enable a greater range of variations and tighter control of the variable movement or reciprocation of the loop pile loopers toward and away from their needles as needed. Thus, for example, the reciprocating movement of the loop pile loopers can be controlled to provide substantially no reciprocation of the loopers toward or away from the needles, or the reciprocation of the loop pile loopers into engagement with their corresponding second or upper pickup area of the needles can be timed (i.e., delayed or enhanced) so that the loop pile loopers engage their respective needles at a desired time to ensure that the loop pile loopers either will not interfere with the pickup of any yarns by the LCL loopers engaging such needles, or that the loop pile loopers will pick up and form a corresponding loop of a non-selected yarn as needed to form the desired pattern design.

Figure 9:
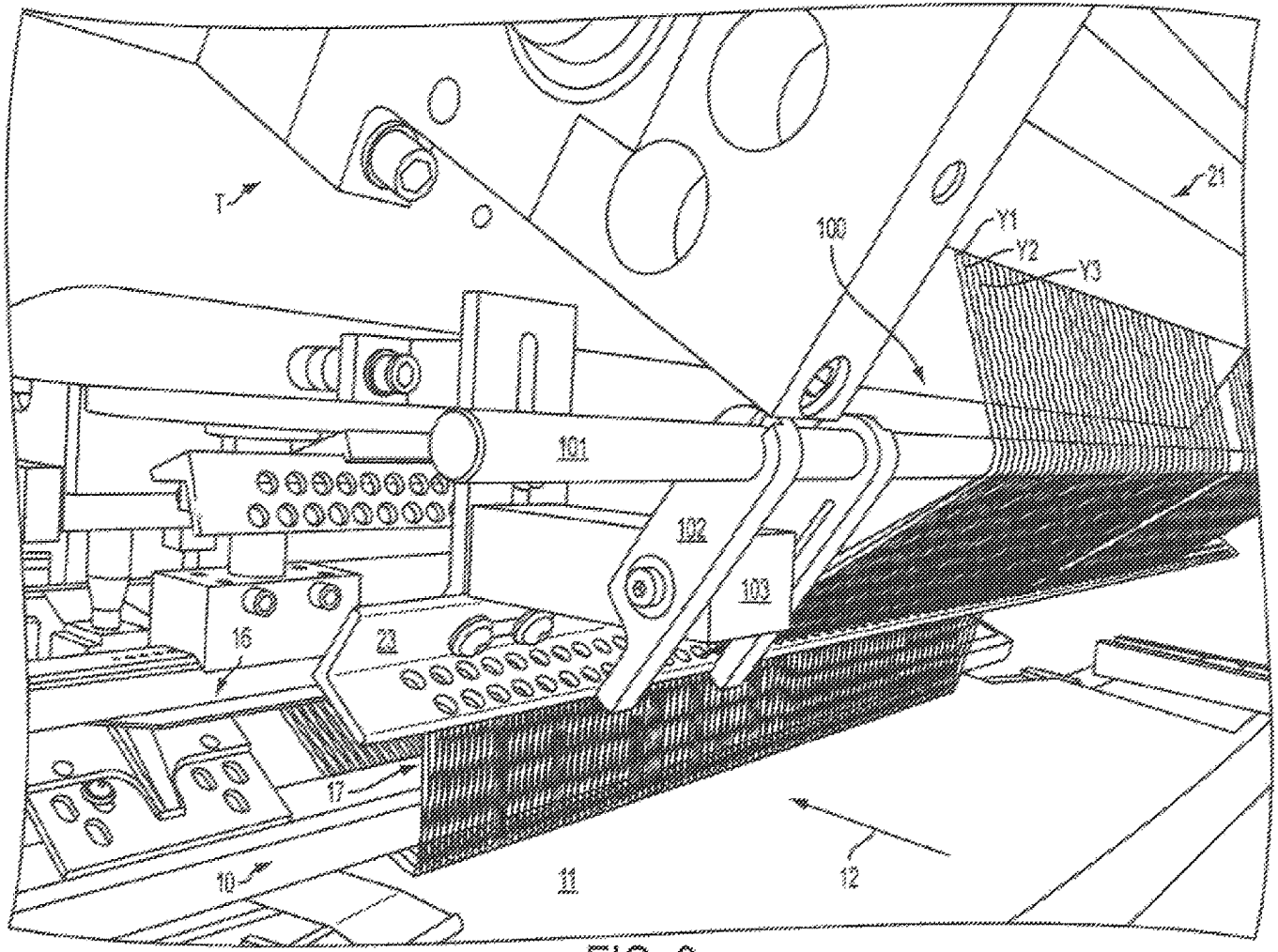
FIG. 9 illustrates the tufting zone of the tufting machine including a yarn jerker and needle guide.

Additionally, as illustrated in FIG. 9, a yarn jerker 100 can be provided between the puller rolls 22A/22B and the yarn guide 23. The yarn jerker 100 generally can comprise an elongated rod or jerker bar 101 extending across the tufting zone 10, with a series of support brackets or holders 102 which movably support the jerker bar 101. The brackets 102 can be pivotally mounted on supports 103 and can be biased forwardly, so as to maintain the jerker bar in a forward position to help maintain a desired tension on the yarns Y-1, Y-2, Y-3, etc. . . . fed to the needles. A biasing mechanism, such as spring, pneumatic cylinder, solenoid, or other, similar mechanism can engage and urge the brackets, and/or the jerker bar itself, toward its forward, extended position to help maintain yarn tension as the needles are reciprocated into and out of the backing material 11.

Figure 10:
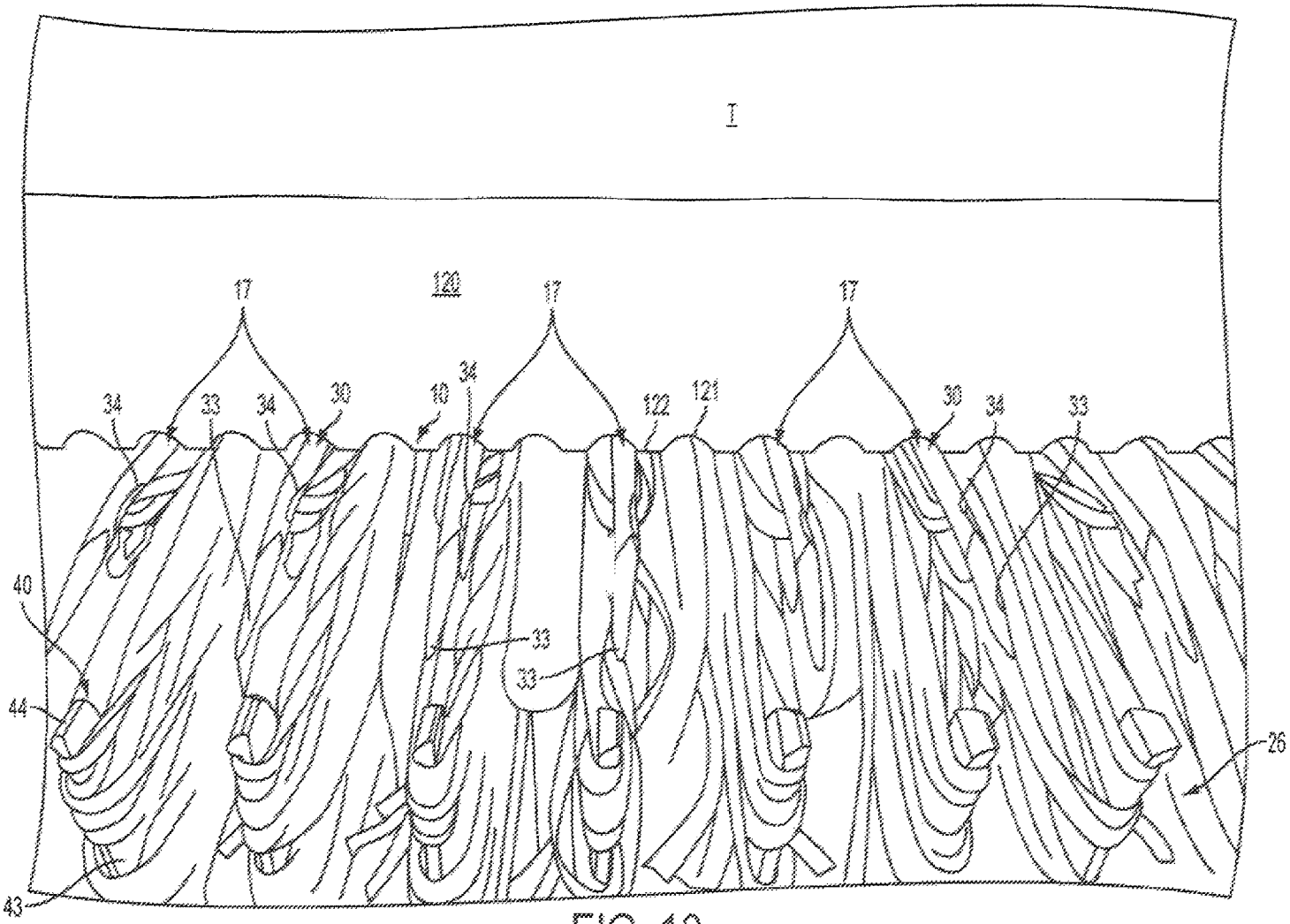
FIG. 10 illustrates a needle guide positioned to engage and support the needles as they penetrate the backing.

FIG. 10 further illustrates a needle guide member or bar 120 mounted adjacent the tufting zone adjacent the needle plate. The needle guide 120 can be formed from various materials, including metals, such as aluminum or steel, and/or composite or synthetic materials such as a bearing grade plastic. The needle guide generally will have a reduced friction surface and/or can be coated with a non-stick, reduced friction coating to avoid binding with the needles. As shown in FIG. 10, the needle guide typically will have a reduced profile, for example, being about ¼-½" thick, and will include a series of gauge grooves 121 formed in series along a first face 122 thereof. The gauge grooves 121 each can be sized and shaped to at least partially receive one of the needles 17 therein as the needles penetrate the backing material 11, and generally will be arranged at spacings based on a gauge spacing between the needles. For example, as shown in FIG. 10, the gauge grooves can be formed at substantially the same spacings as the needles, or at other spacings, such as half the distance or spacing between each needle. The needles will engage and be received within the gauge grooves of the needle guide as illustrated in FIG. 10, for example along an upstream side thereof, so that the needles will be supported thereby to help decrease or substantially minimize or eliminate deflection of the needles caused by movement of the backing material or the construction of its weave as the needles penetrate the backing material. The needle guide bar 120 thus helps maintain longer length needles 17 in a substantially straightened orientation aligned with their associated loopers, cut pile hooks, LCL loopers or other gauge parts during operation of the tufting machine T.

As noted, in forming tufted articles such as tufted artificial/synthetic turf fabric materials having desired graphic patterned effects and/or designs, such as logos, yard lines, etc., the yarns Y1, etc. can include a variety of different color yarns or filaments and/or can include a series of different type filaments or yarns. For example, the tufting machine can be operated with two or more (i.e., 3, 4, 5, 6, 7, 8, or more) different color yarns, thus being able to run as many different colors as needed to create the desired graphic pattern effects. The yarns will be fed to the needles, with the needles generally being arranged in groups or sets, for example, arranged in groups containing a series of one or more different colors. Each group or set of needles will be presented to a predetermined pattern pixel location or stitch area defined across the backing material. Each of the pattern pixel locations or stitch areas generally can be at a size determined by the number of needles in each needle group or set to be presented, increased or multiplied by an approximate desired gauge spacing of the needles within the associated needle group or set.

For example, in a $1/10^{th}$ gauge tufting machine running four colors, the needles can be arranged in sets including all four colors and will be spaced at a gauge $1/10^{th}$ of an inch such that each pattern pixel location or stitch area to which such yarns are presented during each stitch will be approximately $4/10^{ths}$ of an inch. As another alternative, in particular where synthetic grass or turf fabrics are being formed, with multiple colors being used, the size/scope of the pattern pixels can be increased or decreased as needed to provide appropriate fill-in of additional yarns of, for example, the green grass filaments or yarns, between the areas at which colored logos or other design features are being formed. As an example, for a four-color pattern, the yarns presented to each of the pattern pixels could include more than four yarns, i.e., five, six or more yarns, with the additional yarns presented at each pixel being selected as green, grass colored yarns. There alternatively could be fewer yarns presented to each pattern pixel, with the pattern pixels thus being of a smaller size, as needed, to provide the desired patterned appearance with enhanced sharpness and clarity.

In one embodiment of the operation of the tufting machine of the present invention, the needle bar(s) does not have to be shifted to present each of the yarns to each defined pattern pixel or stitch area, rather yarns are presented to each defined pattern pixel or stitch area by the reciprocation of the needles into and out of the backing material. Upon reciprocation of the needles into the backing material, the system control can engage or fire the actuators for the LCL loopers necessary for blocking the pickup and/or retention of non-selected ones of the yarns being presented by the needles at each pattern pixel or stitch location. As shown in FIGS. 7A-7D, engaging the actuators of such LCL loopers 40 will cause their clips 47 to be moved to their extended, blocking positions, preventing the capture and retention yarns along the throats of their corresponding LCL loopers. The selective actuation of the LCL loopers by the system control therefore can determine which of the yarns presented are not to be retained, and thus in turn, which yarns are selected for pick-up by the LCL loopers and retention at each pattern pixel or stitch location so as to form substantially longitudinally extending rows of tufts or stitches in the backing material as the backing material is moved or indexed forwardly at a desired stitch rate.

The remaining, non-selected yarns presented to each pattern pixel or stitch location will be blocked or prevented from being captured on their associated LCL loopers by engagement of the clips of these LCL loopers with the front ends of their LCL loopers. As a result, as indicated in FIGS. 8A-8D, as the needles reciprocate out of the backing material, these non-retained, non-selected yarns accordingly can be withdrawn from the backing material. In conjunction therewith, the system control can control the yarn feed mechanism(s) feeding the non-selected, non-retained yarns to the needles, causing such yarn feed mechanisms to pull back or substantially remove the yarns from the backing material, enabling loops of these yarns to be substantially hidden by selected higher tufts of yarns. These non-retained, non-selected yarns further can be allowed to float on top of the backing material.

Figure 7D:
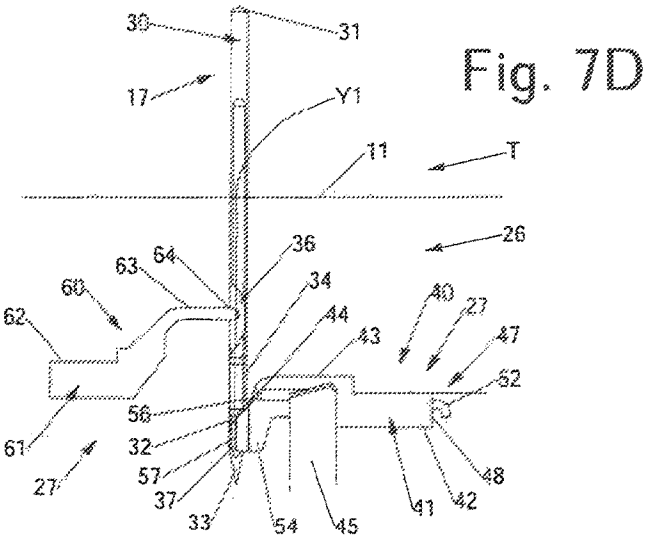
FIGS. 7A-7D schematically illustrate one embodiment of the method of operation of a tufting machine according to the principles of the present invention, wherein the needles are collectively engaged by the level cut loop loopers that control the formation of tufts of yarns within the backing material.
Figure 7B:
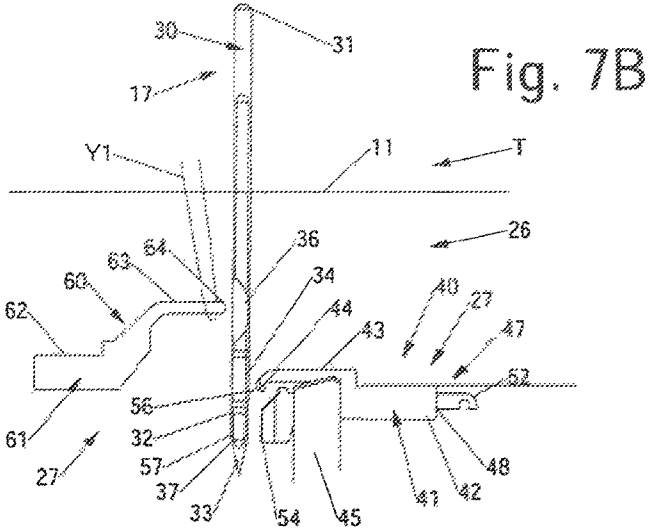
Figure 7C:
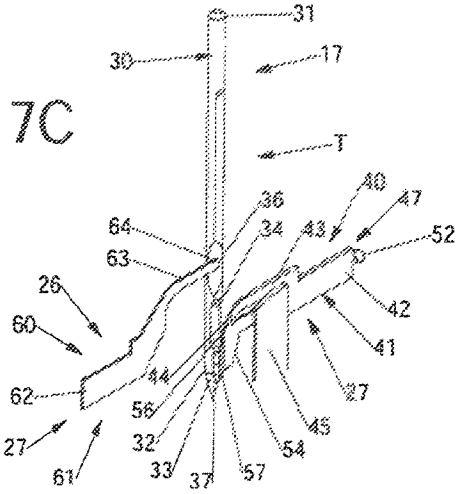
Figure 7A:
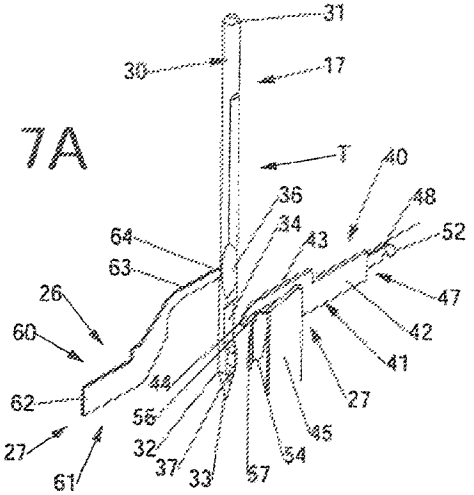
Figure 8D:
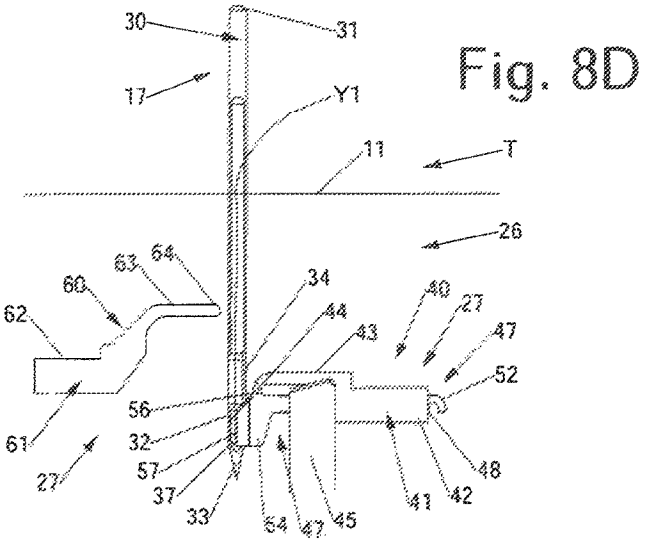
FIGS. 8A-8D schematically illustrate alternative embodiments of the method of operation of a tufting machine according to the principles of the present invention, wherein the needles additionally are engaged by loop pile loopers at a second, upper pick-up area so as to form loop pile tufts of non-selected yarns in the backing material.
Figure 8B:
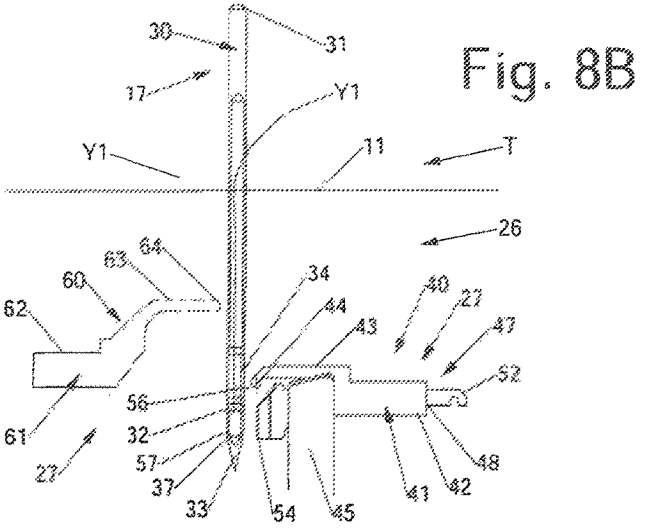
Figure 8C:
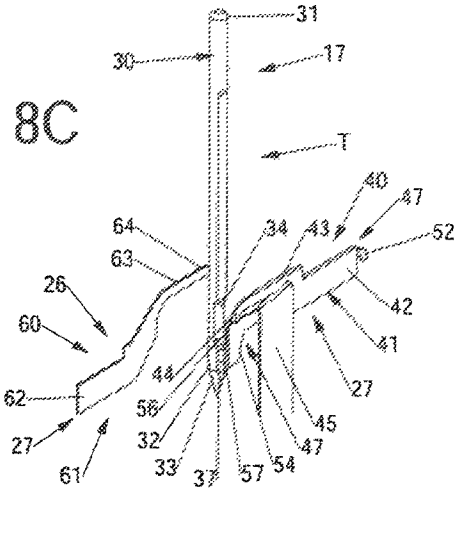
Figure 8A:
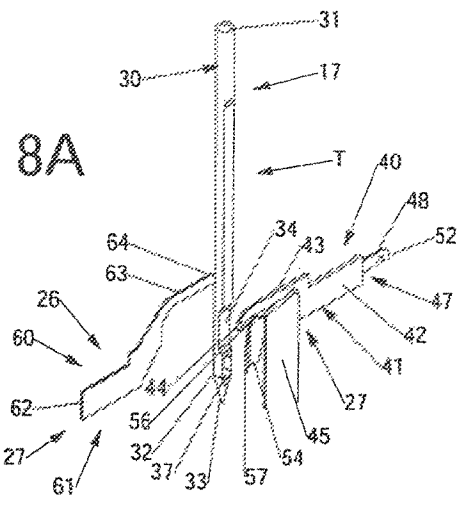

Alternatively, as indicated in FIGS. 7A-7D, the loop pile loopers further can be engaged and operated so as to be reciprocated into engagement with the second pickup areas of each of the needles for engaging and picking up the non-selected, non-retained yarns presented at each of the pattern pixels or stitch locations. The reciprocation of the loop pile loopers further can be controlled so that as they engage the needles, if they engage a needle that is carrying a selected yarn that has been picked up by one of the LCL loopers, the loop pile looper can be moved out of reciprocation with its needle without interfering with the pickup and retention of the selected, retained loop of yarn captured along its corresponding LCL looper. If the yarn being carried by a needle is a yarn that is not captured by the corresponding LCL looper and/or is not being retained at the pattern pixel, the loop pile looper can pick and pull a loop of yarn as it engages the needle and the needle is reciprocated out of the backing material, as shown at FIG. 7D.

Such loops of the non-selected yarns, which are not being retained at each pattern pixel so as to be visible or shown on the face of the carpet, further can be pulled low by the operation of the yarn feed mechanism(s) feeding the yarns to such needles, in cooperation with the operation of the LCL pattern programmed into the system control. Such loops of yarns can be pulled to a lowered desired pile height so as to be substantially hidden from view by the cut pile tufts being formed along the LCL loopers, or can be pulled substantially out of the backing material whereby the non-selected yarns can simply float along the rear side of the backing material as needed. Alternatively, the pile height of the loop pile tufts being formed by the loop pile loopers can be controlled to provide them with a sufficient pile height as needed to provide additional support or stability for the higher cut pile tufts, while still remaining substantially hidden from view along the face of the resultant tufted artificial grass or turf product being formed.

The artificial/synthetic sports grass or turf fabric formed according to the present invention additionally can be formed with multiple cut pile or loop pile tufts, while generally being run in a single pass through the tufting machine, rather than requiring multiple tufting passes and overtufting of the tufted fabric. Additionally, two different length needles can be used, if needed, although it is also possible to use needles of substantially the same length mounted on separate needle bars, and/or with the needles being staggered in terms of their elevation or depth to enable different penetration levels. Still further, the needles can be mounted on a single needle bar in a staggered needle configuration or spacing, or with the needles arranged in-line along the needle bar, and the stroke of the needle bar can be based upon a stroke length or penetration depth required for the longest needle to penetrate and be engaged by its corresponding LCL loopers.

Still further, it also will be understood that in addition to various pattern mechanisms or systems, such as mechanisms or devices to control the feeding of the yarns to the needles and/or movement of the needle bar(s) to prevent excess yarn from being pulled and left on top of the backing material, other patterning systems/attachments for forming various pattern effects, such as sculptured or textured pile effects, or the formation of logos or other designs using various different colors and shades of yarn, including backing feed shifters and other pattern systems, also can be used. For example, the present system can utilize a backing control system such as Card-Monroe Corp.'s Virtual Weave™ to control the shifting of the backing material. Such a backing feed control further can be used in conjunction with one or more shifting needle bars (although shifting needle bar(s) are not required), as well as various pattern yarn feed mechanisms to provide further enhanced patterning and formation of desired visual effects.

Still further, positive stitch placement also can be utilized in operation of the tufting machine, whereby the needle bar(s) are incrementally shifted laterally, generally by an amount or distance less than a spacing or gauge between the needles, back and forth across the backing material as they are reciprocated to form tufts in the backing material. Such positive stitch placement movement of the needles can be done apart from and/or in addition to the needles being shifted in steps or jumps, such as based on the gauge spacings or multiples thereof of the needles mounted along the needle bar, as needed or desired for pattern formation, in order to tighten and substantially eliminate rowing effects of the tufts formed along longitudinal tuft rows in the backing material and to help create a stronger, more natural looking and denser tufted feel to the tufted article. In addition, loop pile tufts can be formed with sufficient density, height, and spacing, to provide enhanced support for the cut pile tufts that generally are of higher pile heights. This can help reduce the amount of fill needed for supporting the tufts, as well as providing better control of the yarn feed to allow for lower weights to the yarns to be used and reduced pile heights of the tufts in order to get the desired density required for enhanced player comfort, support, and ball bounce.

As a result, the finished tufted article, such as a carpet, rug or turf fabric can be formed with a variety of graphic designs and other pattern effects with enhanced clarity and sharpness, and with the tufts of the resultant tufted fabric potentially having enhanced rigidity, resistance, strength and being more resistant to bending over due to loads such as crushing forces during use/play thereon. Still further, the use of various pattern devices as discussed above can enable variable pile heights for the cut and loop pile tufts so as to vary the characteristics of tufted turf fabrics as needed to meet various desired standards for cushioning, support, ball roll, and ball bounce, all while helping to reduce the amount of fill with particulate matter required for support of the tufts, and further enable various designs or pattern effect to also be formed in the resultant tufted turf fabrics.

It will be further understood by those skilled in the art that while the present invention has been described above with reference to preferred embodiments, numerous variations, modifications, and additions can be made thereto without departing from the spirit and scope of the present invention as set forth in the following claims.

What is claimed is:

1. A method of forming tufted articles, comprising:

reciprocating a series of needles into a backing moving therebeneath, wherein the needles are arranged in sets of needles threaded with one or more different colors of yarns;

presenting a series of yarns carried by the sets of needles to a plurality of stitch areas defined across the backing;

as the series of yarns are presented to each of the plurality of stitch areas, selectively activating clips of a series of level cut loop loopers moving toward engagement with the needles, in accordance with an LCL pattern profile to enable pick-up of selected yarns of the series of yarns presented at each stitch area for formation of tufts of the selected yarns at the plurality of stitch areas defined across the backing to form a pattern for the tufted article; and controlling feeding of the yarns presented to each of the plurality of stitch areas by the needles in accordance with the LCL pattern profile so as to form the tufts of the selected yarns at a desired pile height and pull back non-selected yarns to an elevation below the tufts of the selected yarns sufficient to provide support for the tufts of the selected yarns while being substantially hidden from view between the tufts of the selected yarns formed by the level cut loop loopers.

2. The method of claim 1, further comprising moving a series of loop pile loopers into engagement with the needles carrying the non-selected yarns, and picking up and forming loops of yarns with the loop pile loopers so as to form a series of loop pile tufts in the backing.

3. The method of claim 1, wherein selectively activating the series of clips of the level cut loop loopers comprises moving the clips to a blocking position along their level cut loop loopers to substantially prevent pickup of non-selected yarns thereby.

4. The method of claim 1, wherein reciprocating the needles into the backing comprises moving the needles through the backing to a depth sufficient to enable engagement of the needles by the level cut loop loopers at a first elevation, and by a series of loop pile loopers at a second elevation.

5. The method of claim 4, further comprising forming the tufts of the selected yarns picked up by the level cut loopers at a first pile height, and picking up loops of the non-selected yarns from the needles with the loop pile loopers so as to form loop pile tufts of yarns in the backing at a second pile height.

6. The method of claim 1, wherein the needles are mounted in a substantially in-line arrangement along at least one needle bar, and wherein each stitch area is defined approximately by a combined spacing between each of the needles of a needle group formed along the needle bar and associated therewith.

7. The method of claim 6, wherein each needle group comprises at least two needles spaced at a desired gauge spacing based upon the pattern of the tufted article being formed such that each stitch area comprises at least about two times the gauge spacing between the needles of its associated needle group.

8. The method of claim 1, wherein the needles are mounted along a pair of needle bars.

9. The method of claim 1, further comprising shifting the needles by a distance less than a gauge spacing between the needles and sufficient to move tufts of yarns being formed in longitudinal tuft rows of the pattern at least partially out of alignment.

10. A tufting machine, comprising:

one or more needle bars having a series of needles mounted therealong, each needle carrying a yarn and having body including first and second pickup areas;

backing feed rolls for feeding a backing material beneath the needles;

a yarn feed mechanism for feeding the yarns to the needles;

a series of level cut loop loopers reciprocable into engagement with the needles along the first pickup areas thereof when the needles are reciprocated into the backing material for forming tufts of yarns in the backing material, each level cut loop looper comprising a body having a throat and a clip movable along the body between a non-engaging position and an engaging position; and a series of additional gauge parts reciprocable into engagement with the second pickup areas of the needles when the needles are reciprocated into the backing material to form tufts of yarns in the backing material at a different pile height than the tufts of yarns formed by the level cut loop loopers;

wherein the needles are arranged in groups of needles threaded with a series of yarns, and as the needles are reciprocated into the backing material, the groups of needles present a desired number of yarns to each of a series of stitch areas for formation of tufts of selected ones of the yarns in the backing material, and wherein the clips of the level cut loop loopers are controlled to enable pickup of the selected yarns of the yarns presented at each stitch area that are to be retained, while substantially retarding pickup by the level cut loop loopers of non-selected yarns of the yarns presented at each stitch area that are not to be retained, so as to selectively form tufts of yarns of varying pile heights and/or formation of loop and cut pile tufts of yarns in the backing material.

11. The tufting machine of claim 10, further comprising a main drive shaft driving the reciprocating movement of the needle bar and a drive system for driving operation of the level cut loop loopers and the additional gauge parts.

12. The tufting machine of claim 11, wherein the drive system comprises a servo motor driven independently from the main drive shaft of the tufting machine.

13. The tufting machine of claim 11, wherein the drive system is linked to the main drive shaft and drives the upstream and downstream gauge parts in a Velv-a-Loop driving motion.

14. The tufting machine of claim 10, further comprising a needle guide having a series of grooves through which the needles are at least partially received, wherein the needle guide provides support against deflection of the needles as the needles are reciprocated into and out of the backing material.

15. The tufting machine of claim 10, wherein the additional gauge parts comprise a series of loop pile loopers arranged along an upstream side of the tufting machine and reciprocable into engagement with the needles carrying the other yarns of each needle group that are not picked up by the level cut loop loopers for forming a series of loop pile tufts in the backing.

16. A method of tufting patterned artificial turf, comprising:

reciprocating at least a series of needles into and out of a backing, wherein the needles are arranged in sets of spaced needles each carrying a yarn of a selected color or type;

presenting the yarns carried by the sets of needles to pattern pixel locations defined along and/or across the backing as the backing is fed through the tufting machine;

as the needles penetrate the backing and present the yarns carried thereby to the pattern pixel locations, reciprocating a series of level cut loop loopers toward engagement with the needles;

activating a series of clips of at least a portion of the level cut loop loopers to enable pick-up of selected ones of the yarns presented at each pattern pixel location for forming tufts of yarns in the backing, while substantially retarding pick-up of remaining ones of the yarns presented at each pattern pixel location by the level cut loop loopers; and controlling feeding of the yarns presented at each pattern pixel location so that the tufts of the selected ones of the yarns are formed at a desired pile height, while the remaining ones of the yarns presented and not picked up by the level cut loop loopers are pulled back to an extent sufficient to be substantially hidden by the tufts of yarns formed in the backing.

17. The method of claim 16, wherein reciprocating the needles into the backing comprises moving the needles through the backing to a depth sufficient to enable engagement of the needles by the level cut loop loopers at a first elevation, and by a series of loop pile loopers at a second elevation.

18. The method of claim 17, further comprising reciprocating the loop pile loopers into engagement with the needles, and picking up loops of the non-selected yarns from the needles with the loop pile loopers so as to form loop pile tufts of yarns in the backing; and wherein controlling feeding of the yarns further comprises pulling back at least some of the loops of yarns formed by the loop pile loopers to form loop pile tufts of a pile height selected to provide support to the tufts of yarns formed by the level cut loop loopers.

19. The method of claim 16, wherein the needles are mounted in a substantially in-line arrangement along a needle bar, and wherein each pattern pixel location is defined approximately by a combined spacing between each of the needles of the needle set presenting its yarns to the pattern pixel location and associated therewith; wherein each needle group comprises at least two needles, and wherein the needles of each needle set are arranged at a desired gauge spacing based upon the pattern of the tufted article being formed such that each pattern pixel location comprises an area of a size at least about two times the gauge spacing between the needles of its associated needle group.

* * * * *